US009457569B2

(12) United States Patent
Matsui

(10) Patent No.: US 9,457,569 B2
(45) Date of Patent: Oct. 4, 2016

(54) IMAGE FORMATION DEVICE

(71) Applicant: Konica Minolta, Inc., Chiyoda-ku, Tokyo (JP)

(72) Inventor: Yasuhiro Matsui, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/780,200

(22) PCT Filed: Mar. 20, 2014

(86) PCT No.: PCT/JP2014/057683
§ 371 (c)(1),
(2) Date: Sep. 25, 2015

(87) PCT Pub. No.: WO2014/156924
PCT Pub. Date: Oct. 2, 2014

(65) Prior Publication Data

US 2016/0039204 A1 Feb. 11, 2016

(30) Foreign Application Priority Data

Mar. 29, 2013 (JP) ..... 2013-072048

(51) Int. Cl.

| | |
|---|---|
| ***B41J 2/165*** | (2006.01) |
| ***B41J 2/175*** | (2006.01) |
| ***B41J 2/14*** | (2006.01) |
| ***B41J 25/304*** | (2006.01) |
| ***B41J 2/155*** | (2006.01) |

(52) U.S. Cl.
CPC ..... *B41J 2/1433* (2013.01); *B41J 2/155* (2013.01); *B41J 2/175* (2013.01); *B41J 2/17593* (2013.01); *B41J 25/304* (2013.01); *B41J 2002/16564* (2013.01); *B41J 2202/20* (2013.01)

(58) Field of Classification Search
CPC ..... B41J 2/17593; B41J 2/18; B41J 2/2117; B41J 2/48; B41J 2002/16564
See application file for complete search history.

(56) References Cited

FOREIGN PATENT DOCUMENTS

| | | | |
|---|---|---|---|
| JP | H09187959 | A | 7/1997 |
| JP | 2000233515 | A | 8/2000 |
| JP | 2009083470 | A | 4/2009 |

(Continued)

OTHER PUBLICATIONS

International Preliminary Report on Patentabilty corresponding to Applicaton No. PCT/JP2014/057683; Date of Mailing: Sep. 29, 2015, with English translation.

(Continued)

*Primary Examiner* — Geoffrey Mruk
(74) *Attorney, Agent, or Firm* — Cantor Colburn LLP

(57) ABSTRACT

An image formation device may include a recording head which has a plurality of nozzles inlet; a flow channel member which is connected to the inlet and forms a flow channel for supplying the discharge liquid to the recording head; and a heating section which heats the flow channel member. The flow channel member may include a first flow channel section one end of which is inserted into the inlet; and a second flow channel section that is a cylindrical member inside of which the first flow channel section passes through and that externally covers a connection part between the one end of the first flow channel section and the inlet. The second flow channel section may be connected with the first flow channel section and the inlet via an elastic member, and the one end of the first flow channel section and the inlet may be connected.

20 Claims, 11 Drawing Sheets

(56) References Cited

FOREIGN PATENT DOCUMENTS

| | | | | | |
|---|---|---|---|---|---|
| JP | 2009233900 | A | | 10/2009 | |
| JP | 2010069770 | A | | 4/2010 | |
| JP | 2010274554 | A | | 12/2010 | |
| JP | 2013-230633 | | * | 11/2013 | ..... B41J 2/175 |
| JP | 2013230633 | A | | 11/2013 | |

OTHER PUBLICATIONS

Written Opinion of the International Searching Authority corresponding to Application No. PCT/JP2014/057683; Date of Mailing: Jun. 17, 2014.

International Search Report corresponding to Application No. PCT/JP2014/057683; Date of Mailing: Jun. 17, 2014, with English translation.

* cited by examiner

IMAGE FORMATION DEVICE

This is the U.S. national stage of application No. PCT/JP2014/057683, filed on Mar. 20, 2014. Priority under 35 U.S.C. §119(a) and 35 U.S.C. §368(b) is claimed from Japanese Application No. 2013-072048, filed Mar. 29, 2013, the disclosure of which is also incorporated herein by reference.

TECHNICAL FIELD

The present invention relates to an image formation device which includes a mechanism for performing heating control of a discharge liquid.

BACKGROUND ART

There are image formation devices each of which discharges a discharge liquid by providing a heater to a recording head and heating the discharge liquid in the recording head to a predetermined temperature by electric conduction to the heater so that the discharge liquid has a viscosity which can be discharged.

Though various discharge liquids can be used in such image formation devices, in recent years, the requirement for recording and forming images has been increased even on a recording medium such as a plastic sheet which does not absorb a discharge liquid well. Thus, instead of general dye discharge liquid and pigment discharge liquid, an ink such as a gel ink, hot-melt dry ink and wax ink is used, the ink being in a gel form or solid at an ordinary temperature and changing in phase to a liquid form with a lower viscosity by heating (hereinafter, such discharge liquid is described as a phase transition ink).

Since such discharge liquid becomes mostly gelled or solid at a normal temperature, when landing on the recording medium, the viscosity rapidly increases, and thus, it is possible to prevent the image deterioration due to combined adjacent drops of discharge liquid. Accordingly, there is a merit in that recording can be performed with high image quality without generating color mixture even on the above-mentioned recording medium which does not absorb the discharge liquid well.

In an image formation device, the discharge liquid is generally supplied to the recording head via the outside of the recording head, for example, through a supplying flow channel from a discharge liquid tank storing the discharge liquid separately. Thus, it is necessary to not only maintain the stability of viscosity when discharging the liquid but also maintain a predetermined viscosity on a supplying path from the discharge liquid tank to the recording head in order to supply the discharge liquid stably. Especially, this is remarkably necessary for the above-mentioned phase transition ink which sensitively changes in viscosity due to the temperature.

In such circumstances, there are known techniques to heat the supplying path itself as a configuration for heating the ink supplied from outside of the recording head main body (patent documents 1 and 2).

In the patent document 1, in order to efficiently heat the ink supplied to the recording head, a heater is embedded in a base body forming a flow channel for supplying the ink to the recording head, the ink being supplied from outside the recording head, and the heater heats the discharge liquid flowing through the flow channel.

In the patent document 2, in order to evenly heat the ink flowing through the supplying path, the flow channel connecting the recording head and the discharge liquid tank is wounded around the heater, and the discharge liquid flowing through the flow channel is heated.

PRIOR ART DOCUMENTS

Patent Documents

Patent Document 1: Japanese Patent Application Laid Open Publication No. 2009-83470

Patent Document 2: Japanese Patent Application Laid Open Publication No. 2009-233900

DISCLOSURE OF THE INVENTION

Problems to be Solved by the Invention

In recent years, image recording has been speeded up, and accordingly, the discharge amount of discharge liquid per unit time has been also increased. Accordingly, in order to discharge a discharge liquid with a stable discharge viscosity by a recording head in an image recording device which is suitable for such speeded image recording, a heating structure which can rapidly and evenly discharge the discharge liquid with a stable viscosity from the recording head is desired, and thus it is necessary to study the heating structure in consideration of even the connection part between the recording head main body and the heated supplying path.

When studying such heating structure, it is also necessary to consider the connection between the recording head and the supplying path which does not disturb the high positioning accuracy of recording head itself as much as possible since there are image formation devices requiring highly accurate positioning of recording head to the device main body due to the recording head not performing scanning in addition to due to the increase in the number of recording heads, the image formation devices being an image formation device which is superior in speeding up, for example, a full line image formation device in which a plurality of recording heads are disposed along the width direction over the entire width of the recording medium so as to be fixed for respective colors.

However, in a case of above conventional techniques, though the ink can be warmed by heating the ink flow channel and a sub tank, the connection part between the recording head and the supply channel is not heated, and thus, the ink viscosity is increased at the connection part and ink supply to the head becomes unstable. As a result, adjustment such as raising the heating temperature is required. In addition, providing a heater at the connection part between the recording head and the supply channel could not be a heating structure considering maintaining the positioning of head itself to the device main body since heater wiring needs to be provided near the recording head, the wiring disturbs the work of replacing the recording head, and thus, head positioning is disturbed when replacing the head.

An object of the present invention is to provide an image formation device including a supply mechanism of a discharge liquid which can provide the discharge liquid with a stable discharge viscosity even at the connection part between the recording head main body and the supply flow channel connected thereto and does not disturb the high positioning accuracy of recording head to the image formation device main body.

Means for Solving the Problem

In order to achieve the above object, a first aspect of the present invention is an image formation device, including: a recording head which has a plurality of nozzles for discharging a discharge liquid onto a conveyed recording medium, the discharge liquid being supplied to an inside of the recording head through an inlet; a flow channel member which is connected to the inlet and forms a flow channel for supplying the discharge liquid to the recording head; and a heating section which heats the flow channel member, wherein the flow channel member includes: a first flow channel section one end of which is inserted into the inlet; and a second flow channel section that is a cylindrical member inside of which the first flow channel section passes through and that externally covers a connection part between the one end of the first flow channel section and the inlet, and the second flow channel section is connected with each of the first flow channel section and the inlet via an elastic member, and the one end of the first flow channel section and the inlet are connected to each other.

A second aspect is the image formation device according to the first aspect, wherein the first flow channel section is a member having a thermal conductivity of 100 W/(m·K) or more.

A third aspect is the image formation device according to first or second aspect, wherein the second flow channel section is a member having a thermal conductivity less than 100 W/(m·K).

A fourth aspect is the image formation device according to any one of first to third aspects, wherein the flow channel member includes a third flow channel section which is connected to the other end of the first flow channel section, and the first flow channel section and the third flow channel section are connected to each other so as to be attachable and detachable.

A fifth aspect is the image formation device according to the fourth aspect, wherein the heating section heats the third flow channel section.

A sixth aspect is the image formation device according to any one of first to fifth aspects, further including: a plurality of recording heads; and a holding member which holds the plurality of recording heads, wherein the plurality of recording heads is arranged along a direction orthogonal to a conveyance direction of the recording medium so that the nozzles are across an entire width of the direction orthogonal to the conveyance direction of the recording medium.

A seventh aspect is the image formation device according to sixth aspect, wherein the holding member has an opening in which a part of the recording head including a discharge surface to discharge the discharge liquid is insertable, and the recording head includes a recording head fixing section which includes an abutting surface to abut on the holding member, the abutting surface being formed on a side closer to the discharge surface than the inlet and being parallel to the discharge surface, the recording head is held by exposing the discharge surface through the opening and making the abutting surface abut on the holding member, and the one end of the first flow channel section is inserted through the inlet to the abutting surface.

An eighth aspect is the image formation device according to the seventh aspect, wherein the inlet is formed in a shape protruding from the recording head fixing section toward an opposite side of the discharge surface.

A ninth aspect is the image formation device according to any one of first to eighth aspects, wherein the discharge liquid changes in phase between a gel form or a solid form and a liquid form according to a temperature.

A tenth aspect is the image formation device according to ninth aspect, wherein a gelation temperature of the discharge liquid is equal to or more than 40° C. and less than 90° C.

An eleventh aspect is an image formation device, including: a first recording head including a first inlet through which a discharge liquid is supplied, a first outlet from which the discharge liquid flows out, and a plurality of nozzles which discharges the discharge liquid onto a conveyed recording medium, the discharge liquid being supplied to an inside of the first recording head through the first inlet; a second recording head including a second inlet which is connected to the first outlet of the first recording head, a second outlet from which the discharge liquid flows out, and a plurality of nozzles which discharges the discharge liquid onto the conveyed recording medium, the discharge liquid flowing out from the first outlet and being supplied to an inside of the second recording head through the second inlet; a first flow channel member which is connected to the first inlet and forms a flow channel to supply the discharge liquid to the first recording head; a second flow channel member which is connected to the second inlet and forms a flow channel to supply the discharge liquid to the second recording head, the discharge liquid flowing out from the first outlet of the first recording head; and a heating section which heats the first and second flow channel members, wherein each of the first and second flow channel members includes: a first flow channel section one end of which is inserted into the first or second inlet; and a second flow channel section that is a cylindrical member inside of which the first flow channel section passes through and that externally covers a connection part between the one end of the first flow channel section and the first or second inlet, and the second flow channel section is connected with each of the first flow channel section and the first or second inlet via an elastic member, and the one end of the first flow channel section and the first or second inlet are connected to each other.

A twelfth aspect is the image formation device according to the eleventh aspect, wherein the first flow channel section of each of the first flow channel member and the second flow channel member is a member having a thermal conductivity of 100 W/(m·K) or more.

A thirteenth aspect is the image formation device according to eleventh or twelfth aspect, wherein the second flow channel section of each of the first flow channel member and the second flow channel member is a member having a thermal conductivity less than 100 W/(m·K).

A fourteenth aspect is the image formation device according to any one of eleventh to thirteenth aspects, wherein the first flow channel member and the second flow channel member includes a third flow channel section which is connected to the other end of the first flow channel section, and the first flow channel section and the third flow channel section are connected to each other so as to be attachable and detachable.

A fifteenth aspect is the image formation device according to the fourteenth aspect, wherein the heating section heats the third flow channel section.

A sixteenth aspect is the image formation device according to any one of eleventh to fifteenth aspects, further including a holding member which holds the first recording head and the second recording head, wherein the first recording head and the second recording head are arranged along a direction orthogonal to a conveyance direction of the recording medium so that the nozzles are across an entire width of the direction orthogonal to the conveyance direction of the recording medium.

A seventeenth aspect is the image formation device according to the sixteenth aspect, wherein the holding member has an opening in which apart of the first recording head or the second recording head including a discharge surface to discharge the discharge liquid is insertable, and each of the first recording head and the second recording head includes a recording head fixing section which includes an abutting surface to abut on the holding member, the abutting surface being formed on aside closer to the discharge surface than the first inlet or the second inlet and being parallel to the discharge surface, each of the first recording head and the second recording head is held by exposing the discharge surface through the opening and making the abutting surface abut on the holding member, and the one end of the first flow channel section is inserted through the first inlet or the second inlet to the abutting surface.

An eighteenth aspect is the image formation device according to the seventeenth aspect, wherein each of the first inlet and the second inlet is formed in a shape protruding from the recording head fixing section toward an opposite side of the discharge surface.

A nineteenth aspect is the image formation device according to anyone of eleventh to eighteenth aspects, wherein the discharge liquid changes in phase between a gel form or a solid form and a liquid form according to a temperature.

A twentieth aspect is the image formation device according to the nineteenth aspect, wherein a gelation temperature of the discharge liquid is equal to or more than 40° C. and less than 90° C.

Effects of the Invention

According to the image formation device of the present invention, it is possible to supply a discharge liquid with a stable viscosity to the recording head without disturbing the positioning of the recording head.

EMBODIMENTS FOR CARRYING OUT THE INVENTION

Figure 1:
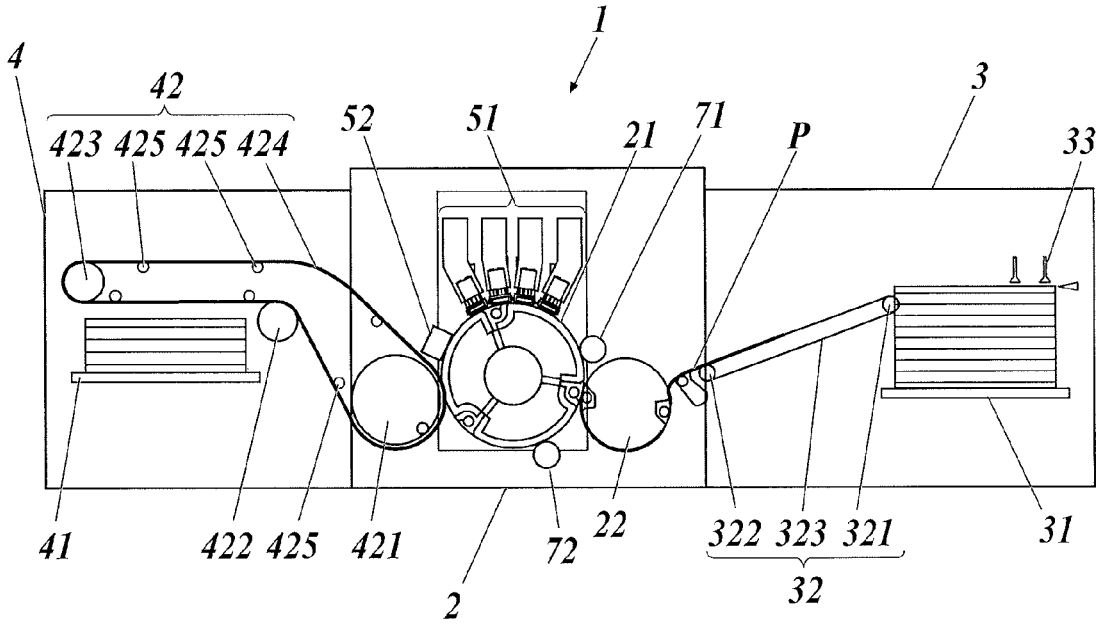
FIG. 1 This is a typical view of the internal configuration of an image formation device of the present invention.

The best modes to carry out the present invention are described below with reference to the drawings. Although various limitations which are technically preferable to carry out the present invention are added in the embodiments below, the scope of the invention is not limited to the embodiments below and the examples shown in the drawings.

(Entire Configuration)

FIG. 1 is a typical view of the internal configuration of an image formation device of an embodiment of the present invention. As shown in FIG. 1, an image formation device 1 of the present embodiment includes an image formation section 2, a paper feed section 3 which feeds paper to the image formation section 2, and an accumulation section 4 which accumulates a recording medium P on which image formation has been performed at the image formation section 2.

(Paper Feed Section)

The paper feed section 3 includes a paper feed tray 31 for storing recording media P, a paper feed conveyance section 32 for conveying a recording medium P from the paper feed tray 31 to the image formation section 2, a supplying section 33 which supplies a recording medium P in the paper feed tray 31 to the paper feed conveyance section 32. The paper feed conveyance section 32 includes a pair of paper feed conveyance rollers 321 and 322, and a paper feed conveyance belt 323 is stretched between the paper feed conveyance rollers 321 and 322. The paper feed conveyance belt 323 carries a recording medium P supplied from the paper feed tray 31 by the supplying section 33 to the image formation section 2.

(Accumulation Section)

The accumulation section 4 includes a storage tray 41 for storing a recording medium P on which image formation has been performed, and a accumulation conveying section 42 for accumulation which conveys a recording medium P from the image formation section 2 to the storage tray 41. The accumulation conveying section 42 includes a plurality of accumulation conveying chain sprockets 421, 422 and 423. Among the plurality of accumulation conveying chain sprockets 421 to 423, one accumulation conveying chain sprocket 421 is disposed in the image formation section 2, and the other accumulation conveying chain sprockets 422 and 423 are disposed in the accumulation section 4. A recording medium P on which image formation has been performed at the image formation section 2 is conveyed, with the recording medium P held on the conveying belt 424 by accumulation nails 425. When the recording medium P comes to the position above the storage tray 41, the recording medium P is released from the accumulation nails 425 and put into the storage tray 41.

(Image Formation Section)

Figure 2:
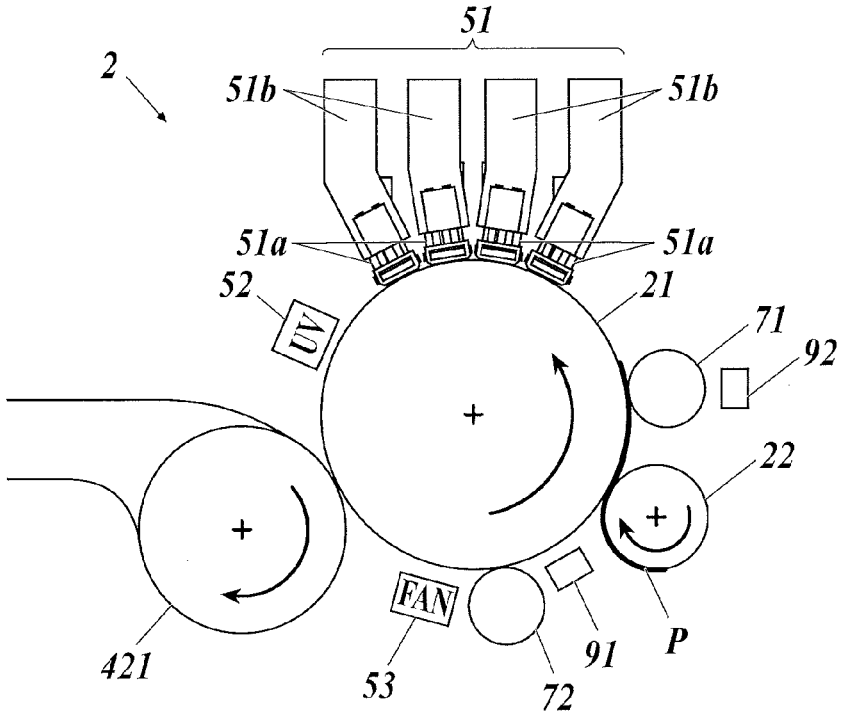
FIG. 2 This is a typical view showing the internal configuration of an image formation section.

FIG. 2 is a typical view showing the internal configuration of the image formation section 2. As shown in FIG. 2, in order to perform image formation on a recording medium P, the image formation section 2 includes an image formation drum 21 which holds a recording medium P on its surface, and a delivering drum 22 which delivers a recording medium P, which is carried from the paper feed section 3, to the image formation drum 21.

The delivering drum 22 includes a plurality of nails (not shown) to catch one end portion of a recording medium P, and an adsorption section (not shown) to make a recording medium P stick to the outer peripheral surface of the delivering drum 22, so as to hold a recording medium P at the outer peripheral surface. The adsorption section makes a recording medium P to stick to the outer peripheral surface of the delivering drum 22 by an electrostatic adsorption or suction. A part of the outer periphery of the delivering drum 22 is adjacent to the image formation drum 21. The delivering drum 22 delivers a recording medium P to the image formation drum 21 at this adjacent part.

Figure 3:
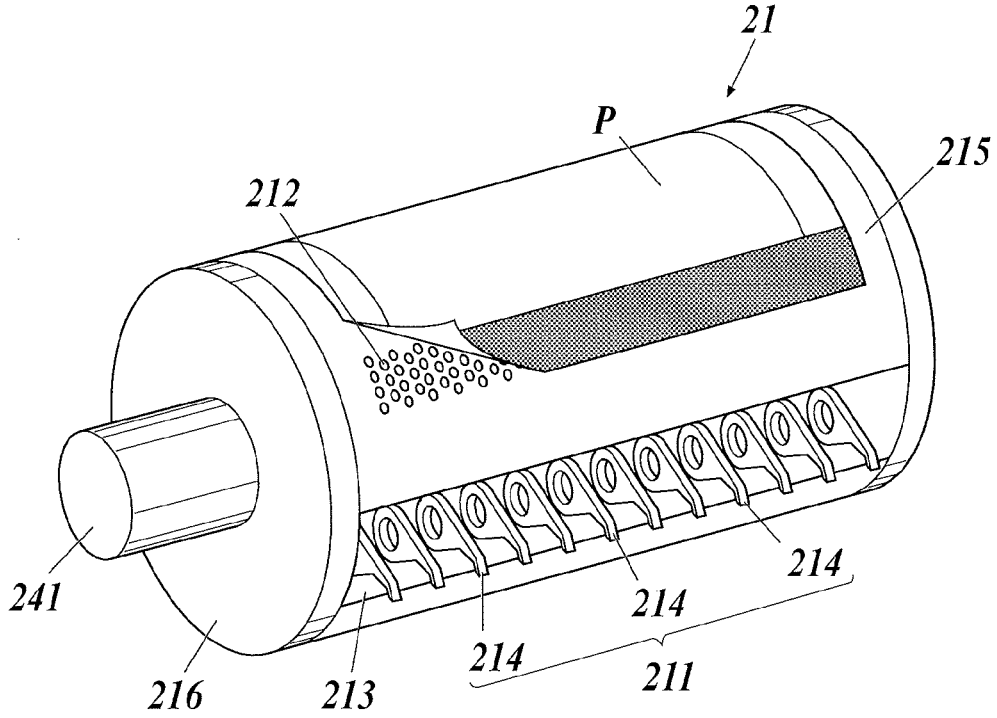
FIG. 3 This is a schematic view showing an outline configuration of an image formation drum.
Figure 4:
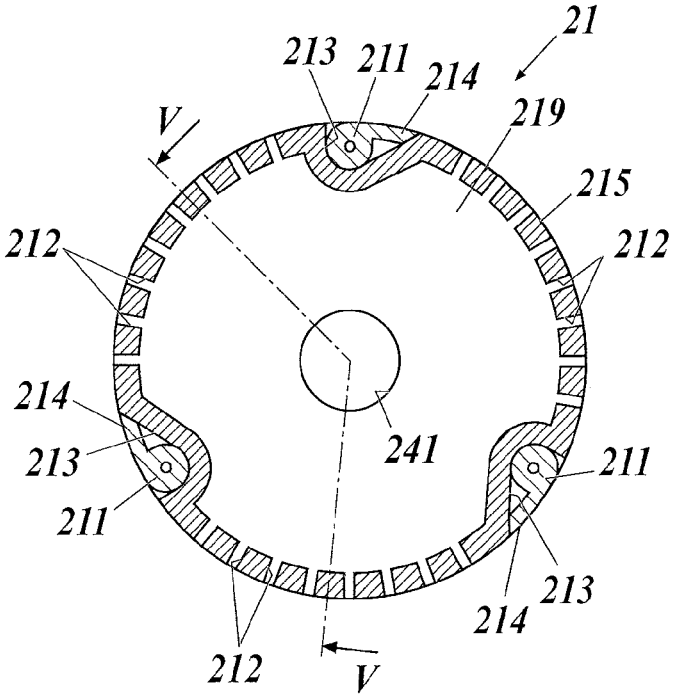
FIG. 4 This is a sectional view showing an outline configuration of the image formation drum of FIG. 3, seen from the cut plane of IV-IV in FIG. 5.
Figure 5:
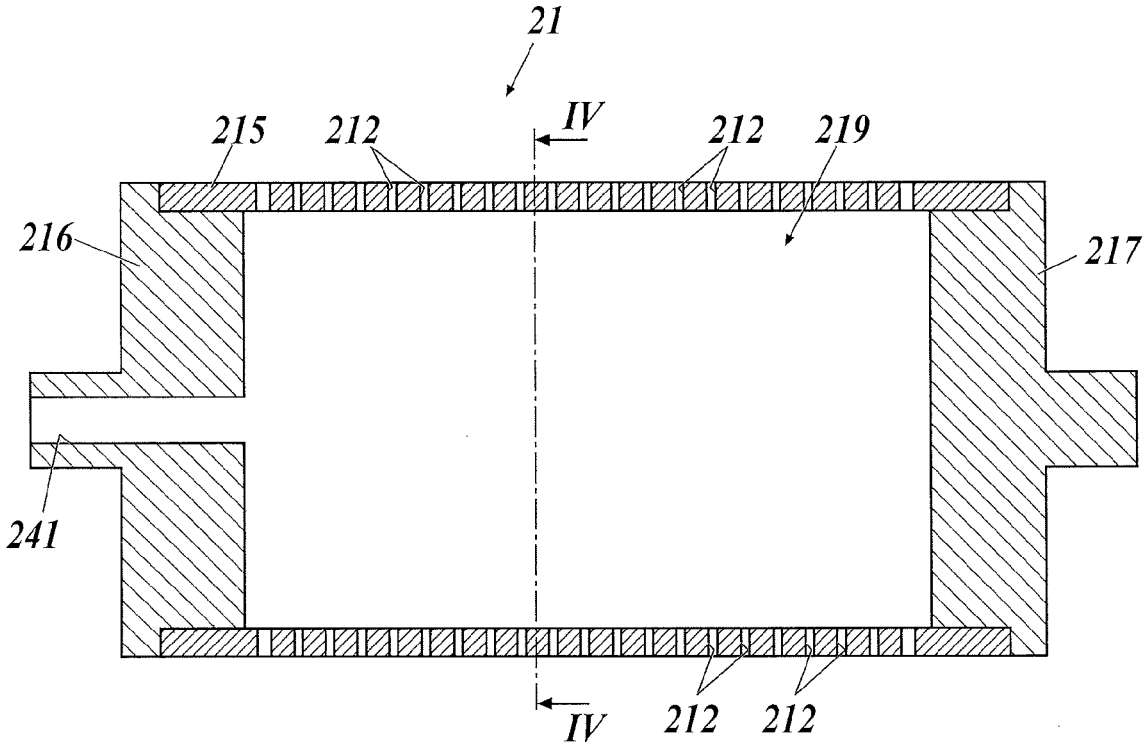
FIG. 5 This is a sectional view showing an outline configuration of the image formation drum of FIG. 3, seen from the cut plane V-V in FIG. 4.

FIG. 3 is a schematic view showing an outline configuration of the image formation drum 21. FIG. 4 is a sectional view showing an outline configuration of the image formation drum 21, seen from the cut plane of IV-IV in FIG. 5. FIG. 5 is a sectional view showing an outline configuration of the image formation drum 21, seen from the cut plane V-V in FIG. 4. As shown in FIGS. 3 to 5, the image formation drum 21 is provided with a main body section 215 in a cylindrical shape the inside of which is hollow, and a pair of supporting sections 216 and 217 which is separate from the main body section 215 and supports both ends of the main body section 215.

Around the main body section 215, a plurality of nails 211 to catch one end portion of a recording medium P are provided so that the main body section 215 holds a recording medium P on its outer peripheral surface. The nails 211 are contained along the axis direction in each of concave portions 213 formed on the outer peripheral surface of the main body section 215. The tips 214 of the nails 211 can touch and get out of touch with the outer peripheral surface of the image formation drum 21. A recording medium P is held on the outer peripheral surface of the image formation drum 21 in such a way that the tips 214 of the nails 211 and the outer peripheral surface of the image formation drum 21 catch the end portion of the recording medium P. Around the main body section 215, a plurality of suction holes 212 are formed for a recording medium P to stick to the outer peripheral surface of the main body section 215.

The pair of supporting sections 216 and 217 stick to the main body section 215 over its entire circumference. Among the pair of supporting sections 216 and 217, one supporting section 216 has a communication opening 241 which communicates with the interior of the hollow portion 219 of the main body section 215. A suction pump (not shown), for example, is connected to the communication opening 241. The suction pump causes the hollow portion 219 of the image formation drum 21 to be at a negative pressure. When the hollow portion 219 is at a negative pressure, a recording medium P sticks to the outer peripheral surface of the main body section 215 through the suction holes 212.

The plurality of suction holes 212 of the adsorption section are arranged in a pattern having blue noise characteristics. Therefore, even when the marks of the suction holes 212 are left on a recording medium P after image formation, the irregular patter makes the marks visually inconspicuous. Further, since the suction holes 212 are disposed only in the area outside of the image formation area of a recording medium P, the marks of the suction holes 212 are prevented from being left in the image formation area.

The image formation section 2 uses a discharge liquid (described later in detail) which changes in phase from a gel form to a liquid form in accordance with temperature. At the time of image formation, temperature regulation is performed by heating a recording medium P so as to control the smoothness and the gloss of discharge liquid dots. Therefore, it is assumed that the image formation drum 21 is heated, and the outer peripheral surface of the image formation drum 21 has a multi-layer structure where a heat-storage layer is formed on a heat-insulating layer.

As shown in FIG. 2, the image formation section 2 includes a plurality of discharge sections 51, a UV lamp 52, a drum temperature sensor 91, heating rollers 71 and 72 and a cooling fan 53, which are disposed around the image formation drum 21.

Each of the discharge sections 51 is configured by including ahead section 51*a* which discharges a discharge liquid and a carriage 51*b* which holds the head section 51*a* (to be described in detail later).

The plurality of discharge sections 51 (head sections 51*a*) are disposed along the circumferential direction of the image formation drum 21 so as to be aligned in the conveyance direction Y (see FIG. 12) of recording medium P. Each of the head section 51*a* of discharge section 51 is a line type recording head extending over the entire length of the image formation drum 21. The image formation device 1 according to the present embodiment includes a total of four discharge sections 51 to eject discharge liquids of four colors of Black (K), Yellow (Y), Magenta (M) and Cyan (C). The number of discharge sections 51 may be increased or decreased according to the number of required colors.

The discharge liquids ejected from the head sections 51*a* of the discharge sections 51 change in phase between a gel form or a solid form and a liquid form in accordance with temperature. The discharge liquids have a phase transition point at not less than 40° C. and less than 100° C. Among the discharge liquids ejected from the discharge sections 51, a discharge liquid ejected at the upstream side in the conveyance direction Y has a higher phase transition temperature than a discharge liquid ejected at the downstream side in the conveyance direction Y.

The phase transition temperature of a discharge liquid can be adjusted by varying the type of gelling agent to be added to the discharge liquid, the amount of added gelling agent, and the type of activating beam curable monomer. By performing such adjustments, the phase transition temperature of a discharge liquid ejected at the upstream side in the conveyance direction Y is set to be higher than that of a discharge liquid ejected at the downstream side in the conveyance direction Y, as described above. Specifically, among the plurality of discharge sections 51 (head sections 51*a*), the phase transition temperature of the discharge liquid ejected from each discharge section 51 is adjusted such that the difference between the phase transition temperatures of the inks ejected from a pair of discharge sections 51, respectively, adjacent to each other in the conveyance direction Y falls within the range of not less than 0.5° C. and not more than 10° C., and more preferably, in the range of not less than 1° C. and not more than 5° C. The details about discharge liquid are described later.

As shown in FIG. 2, a UV (ultraviolet) lamp 52 which emits energy rays such as ultraviolet rays, is disposed immediately downstream of the plurality of discharge sections 51 in the conveyance direction Y of a recording medium P. The UV lamp 52 extends over the entire length of the image formation drum 21, and irradiates a recording medium P on the image formation drum 21 with energy rays.

When ultraviolet rays are used as the energy rays, the examples of a source of ultraviolet irradiation include a fluorescent tube (low-pressure mercury lamp and a sterilization lamp); a cold-cathode tube; an ultraviolet laser;

low-pressure, medium-pressure and high-pressure mercury lamps having an operating pressure of from several hundred Pa to 1 MPa; a metal halide lamp; and an LED. In the light of curability, a light source which can emit UV light having a high illumination intensity of 100 mW/cm$^2$ or more, such as a high-pressure mercury lamp, a metal halide lamp, and an LED, is preferable. Above all, an LED which consumes less power is preferable, but the light source is not limited thereto.

Immediately downstream of the UV lamp 52 in the conveyance direction Y, the accumulation conveying chain sprocket 421 of the accumulation conveying section 42 mentioned above is disposed. A part of the outer periphery of the accumulation conveying chain sprocket 421 is adjacent to the image formation drum 21 via the conveying belt 424. A recording medium P is delivered from the image formation drum 21 to the conveying belt 424 at the adjacent part. Further, immediately downstream of the accumulation conveying chain sprocket 421, the cooling fan 53 which sends air to cool the outer peripheral surface of the image formation drum 21 is disposed.

Immediately downstream of the cooling fan 53, the heating roller 72 is disposed. Further, immediately downstream the heating roller 72, the drum temperature sensor 91, which measures the surface temperature of the image formation drum 21, is disposed. A contact-type temperature detection element, such as a thermocouple and a thermistor, may be used as the drum temperature sensor 91, but a contactless temperature detection element, such as a thermopile, is more preferable.

The heating roller 71 (heating body) is disposed immediately downstream of the delivering drum 22 in the conveyance direction Y, i.e., disposed between the delivering drum 22 and the discharge sections 51, the heating roller 71 heating a recording medium P held on the image formation drum 21 before recording is performed on the medium P by the discharge sections 51. Apart of the heating roller 71 is in contact with the outer peripheral surface of the image formation drum 21. At the time of image formation, a recording medium P is disposed between the heating roller 71 and the image formation drum 21. At this time, the heating roller 71 presses a recording medium P against the outer peripheral surface of the image formation drum 21 so as to bring the recording medium P into close contact with the image formation drum 21.

Figure 6:
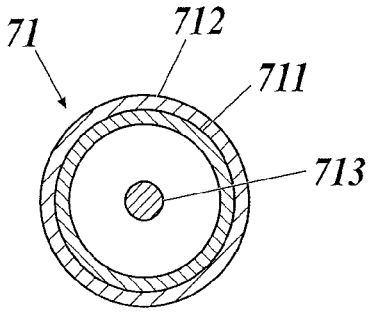
FIG. 6 This is a cross-sectional view showing an outline configuration of a heating roller.

FIG. 6 is a cross-sectional view showing the schematic configuration of the heating roller 71. As shown in FIG. 6, the heating roller 71 includes a hollow pipe 711 composed of a metal such as aluminum; an elastic layer 712, such as a silicon rubber, which covers the entire circumference of the hollow pipe 711; and a heat source 713, such as a halogen heater, which is built in the hollow pipe 711 to heat the hollow pipe 711 and the elastic layer 712.

The elastic layer 712 is preferably made of material having good thermal conductivity. Further, the surface of the elastic layer 712 may be coated with a material (such as a PFA tube) which slide smoothly to improve durability.

The image formation device 1 is provided with a heating-section temperature sensor 92, in addition to the heating roller 71, to detect the temperature of the heating roller 71. A contact-type temperature detection element, such as a thermocouple and a thermistor, may be used as the heating-section temperature sensor 92, but a contactless temperature detection element, such as a thermopile, is more preferable, similarly to the drum temperature sensor 91. The heating roller 72 (heating body), which is disposed downstream of the accumulation conveying chain sprocket 421 and upstream of the delivering drum 22 around the image formation drum 21 (to be more exact, which is disposed between the cooling fan 53 and the drum temperature sensor 91), has a structure identical to that of the heating roller 71.

(Specific Configuration of Discharge Section)

Figure 7:
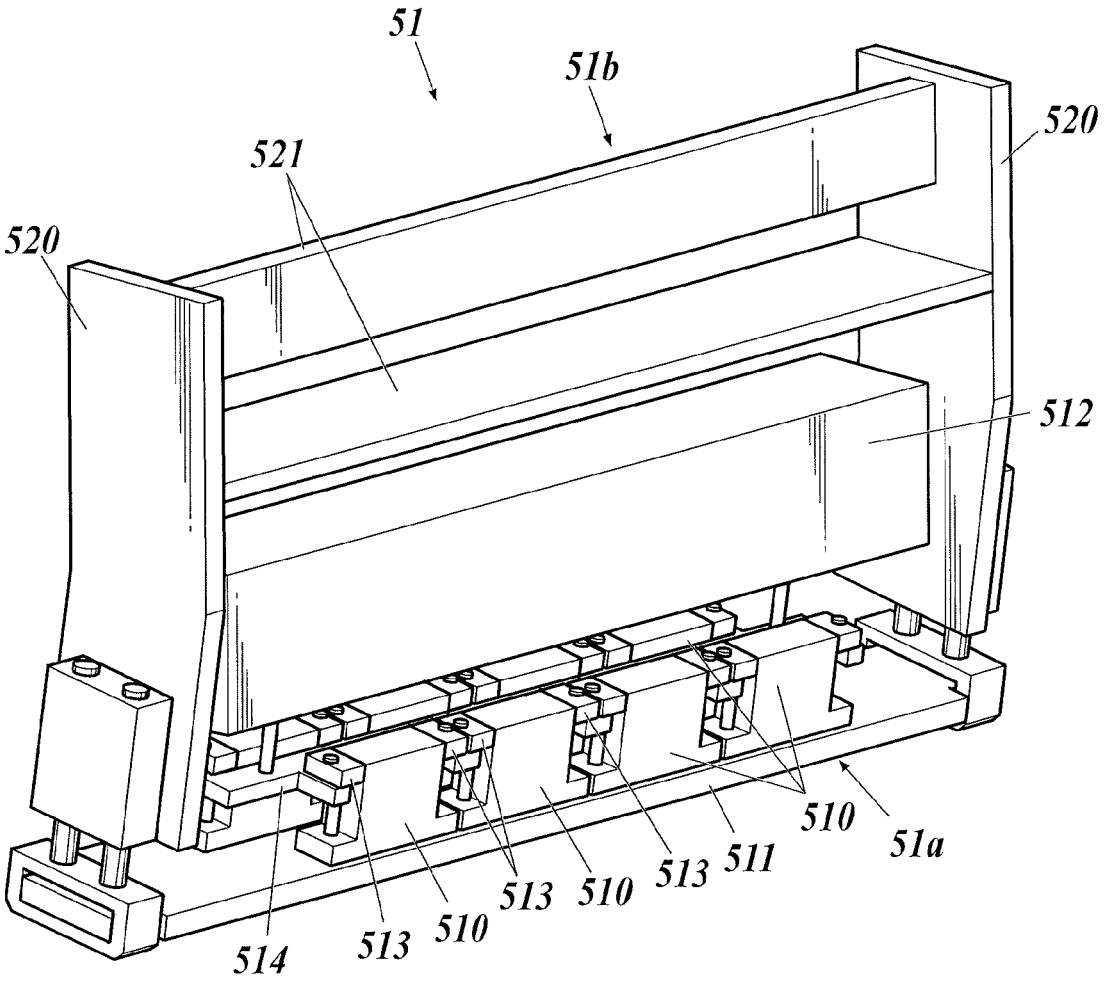
FIG. 7 This is a schematic view showing the outline configuration of a discharge section of the image formation device.

FIG. 7 is a schematic view showing the configuration of discharge section 51.

As shown in FIG. 7, the discharge section 51 includes the head section 51*a* and the carriage 51*b* holding the head section 51*a*. The head section 51*a* includes a plurality of recording heads 510 which discharges a discharge liquid, a recording head fixing plate 511 on which the plurality of recording heads 510 are disposed, a discharge liquid tank 512 which stores the discharge liquid supplied to the recording heads 510, and a flow channel for supplying the discharge liquid from the discharge liquid tank 512 to the recording heads 510.

The recording head fixing plate 511 of the head section 51*a* has a length over the entire length of the image formation drum 21, and the plurality of recording heads 510 are arranged in a plurality of lines along the direction (for example, direction orthogonal to the conveyance direction Y) crossing the conveyance direction Y of the recording medium P by the image formation drum 21. This configuration is what is called a full line recording system.

Figure 12:
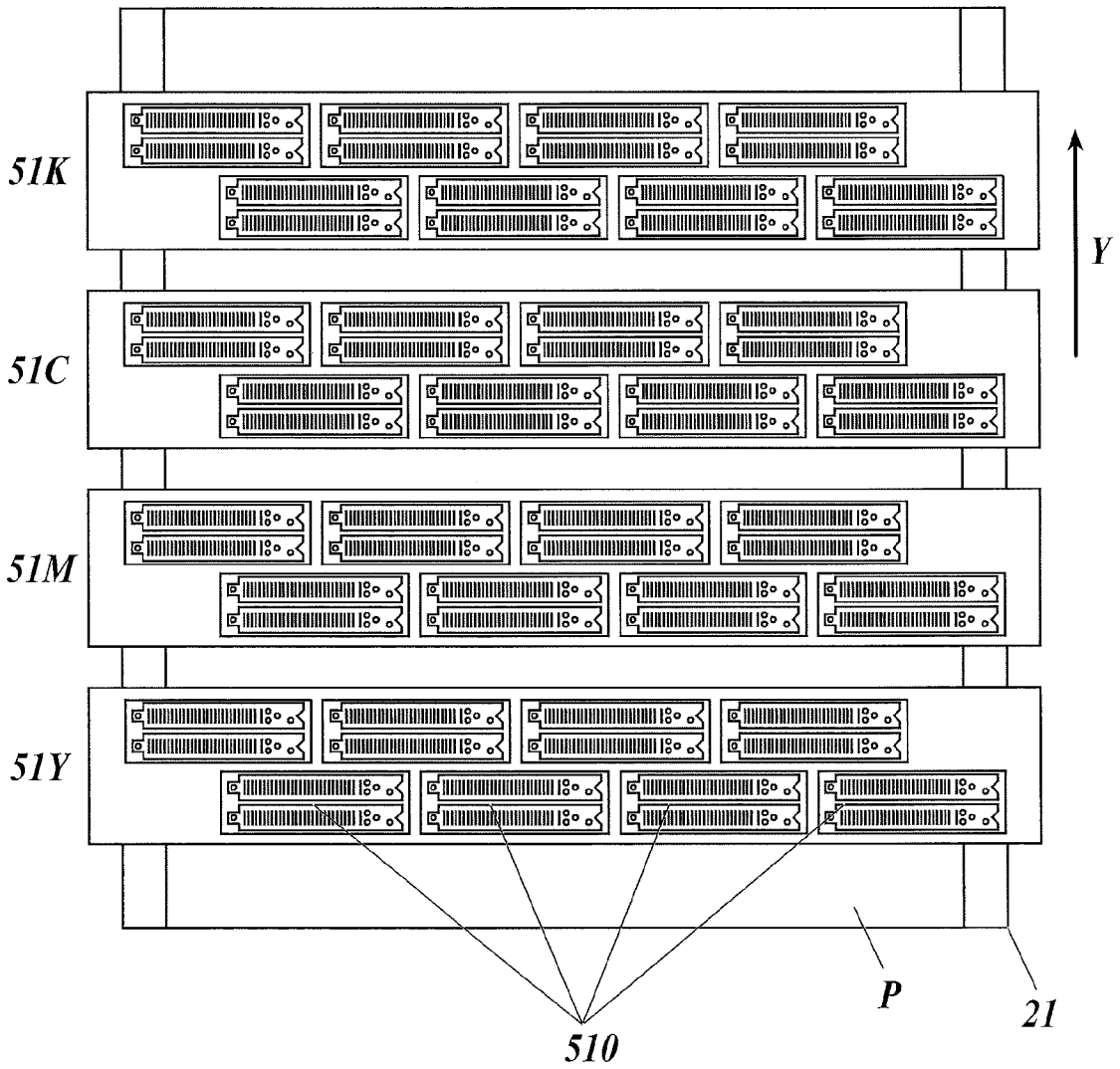
FIG. 12 This is a conceptual view showing a positional relationship between the recording head and a recording medium in a full line recording system.

FIG. 12 is a conceptual view showing the head location in the discharge section 51 and the positional relationship between the heads and the recording medium P in the embodiment. As seen from the positional relationship between the recording medium P and the nozzles discharging discharge liquids of the plurality of recording heads 510 inside each of the discharge sections 51Y, 51M, 51C and 51K which respectively discharge yellow, magenta, cyan and black inks, the full line recording system is a recording system in which long recording heads are used, each of the recording heads having nozzles, over the entire recording width, for discharging a discharge liquid, the recording medium P is moved in the conveyance direction Y, and main scanning in the direction orthogonal to the conveyance direction Y is not performed. Compared to the scan type, this system is excellent in high speed recording since recording can be performed over the entire recording width without performing main scanning. Here, if a single recording head 510 is lengthened over the entire width of the recording medium P, it is difficult to form nozzle pitch or the like with high accuracy, and thus, a plurality of short recording heads 510 are connected to each other along the arrangement direction of nozzles discharging the discharge liquid. Each of the recording heads 510 has a plurality of nozzles. The recording head 510 discharges an ink from the plurality of nozzles to form an image on the recording medium P held on the image formation drum 21. That is, the recording head 510 is provided to be exposed at the lower side thereof so that the plurality of nozzles face the recording medium P. In the recording head 510 of the embodiment, nozzles are provided in two lines along the direction orthogonal to the conveyance direction Y of the recording medium P, two recording heads 510 form a pair, and a plurality of pairs of the recording heads 510 are provided along the direction orthogonal to the conveyance direction Y of the recording medium P to make lines of recording heads 510. Furthermore, the plurality of lines of recording heads 510 are provided so that the positional relationship between the pairs of recording heads 510 in adjacent lines makes a staggered arrangement in the conveyance direction Y of the recording medium P.

As shown in FIG. 12, as for recording head lines formed of recording heads 510 inside each of the discharge sections 51Y, 51M, 51C and 51K, two recording head lines are arranged in the conveyance direction Y for each of the discharge sections, and each recording head line is arranged so as to be shifted from each other in the nozzle line direction, which is what is called a staggered arrangement configuration.

Figure 13:
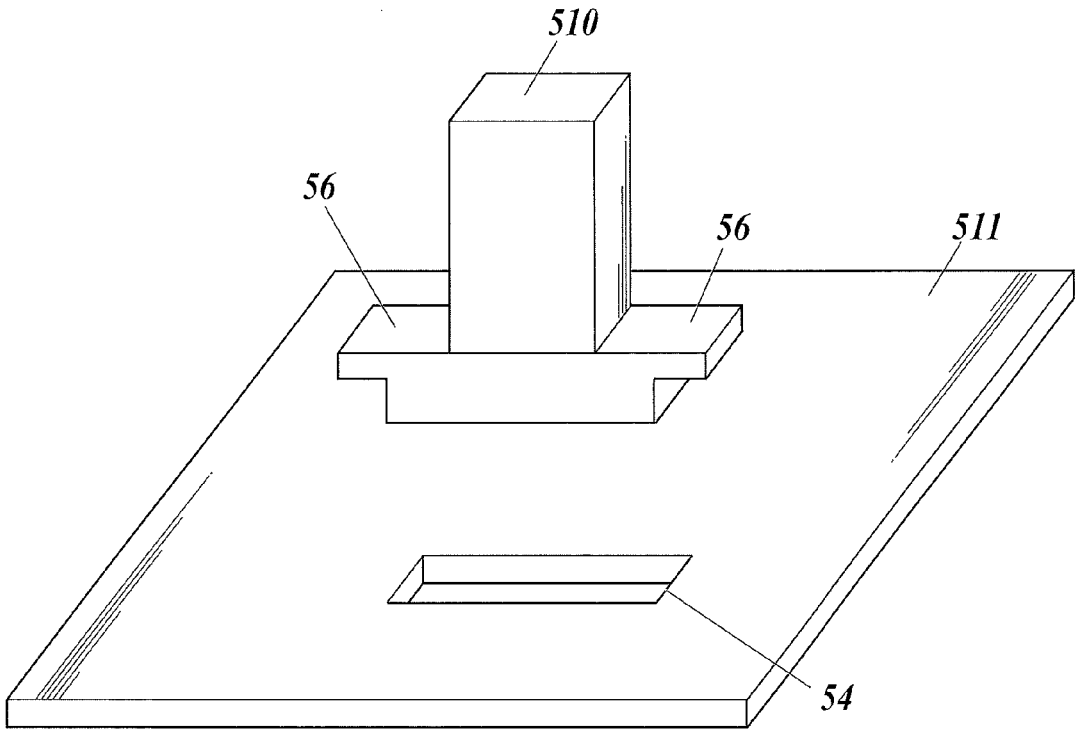
FIG. 13 This is an outline view showing a configuration of fixation of the recording head.

Next, fixing structure of recording heads 510 to the recording head fixing plate 511 will be described by using FIG. 13. For the purpose of illustration, FIG. 13 is an outline view when a single short recording head 510 is fixed to the recording head fixing plate 511; however, in the embodiment, a plurality of recording heads 510 are disposed on the recording head fixing plate 511 for each of the discharge sections 51 as mentioned above.

At the position to dispose each of the recording heads 510, the recording head fixing plate 511 is provided with a frame (recording head fixing frame) 54 which has an opening to insert a part of the recording head 510 including a discharge surface 55 (see FIG. 9) discharging a discharge liquid and fixes the position of the recording head 510. The discharge surface 55 is exposed through the opening so as to face the conveyed recording medium P. A recording head fixing section 56 has a larger circumference than that of the recording head fixing frame 54, and includes abutting surfaces 56A (see FIG. 9) of recording head fixing section 56 which can abut on the upper surface 511B (see FIG. 9) of the recording head fixing plate 511. The abutting surfaces 56A are positioned between the above-mentioned inlet of the recording head 510 and the discharge surface 55 of the recording head 510, and are formed of surfaces parallel to the discharge surface 55. Since the abutting surfaces 56A are also formed to be parallel to the upper surface 511B of the recording head fixing plate 511, the recording head 510 is held to the recording head fixing plate 511 by the abutting surfaces 56A and the upper surface 511B abutting on each other. By the upper surface 511B of the recording head fixing plate 511 and the abutting surfaces 56A of the recording head fixing section 56 abutting on each other and by the pressing force being applied to the recording head 510 in the direction to discharge a discharge liquid, the recording head 510 is supported and fixed at a position appropriate for image formation by the abutting recording head fixing plate 511. The method for fixing the recording head 510 to the recording head fixing plate 511 is not limited to the above-mentioned method, and the recording head 510 may be fixed by providing nails to the recording head 510 and the recording head fixing plate 511 and fitting the nails to each other, for example.

The carriage 51*b* includes a pair of arms 520 holding the recording head fixing plate 511 so as to sandwich the both ends thereof and two connecting plates 521 connecting the pair of arms 520.

The carriage 51*b* is connected to a rail (not shown in the drawings) which extends in the direction crossing (for example, direction orthogonal to) the conveyance direction Y of the recording medium P. The carriage 51*b* is provided so as to be movable in the direction crossing the conveyance direction Y of the recording medium P along the rail, and the head section 51*a* held by the carriage 51*b* can be moved in the direction crossing the conveyance direction Y. That is, carriages 51*b* support the respective plurality of head sections 51*a* provided for respective colors to be individually movable.

The discharge sections 51Y, 51M, 51C and 51K can be moved to print positions facing the image formation drum 21 to perform image formation and to maintenance positions to depart from the image formation drum 21 in the direction crossing the conveyance direction Y of the recording medium P, preferably, in the direction orthogonal to the conveyance direction Y. When perform printing, the discharge sections 51 are fixed at the print positions facing the image formation drum 21 to perform image formation.

(Specific Configuration of Flow Channel Member to Supply Discharge Liquid to Recording Head)

The discharge section 51 shown in FIG. 7 has a configuration of circulation flow channel through which the discharge liquid of discharge liquid tank 512 flows in the plurality of recording heads 510 and returns to the discharge liquid tank 512 again.

Figure 11:
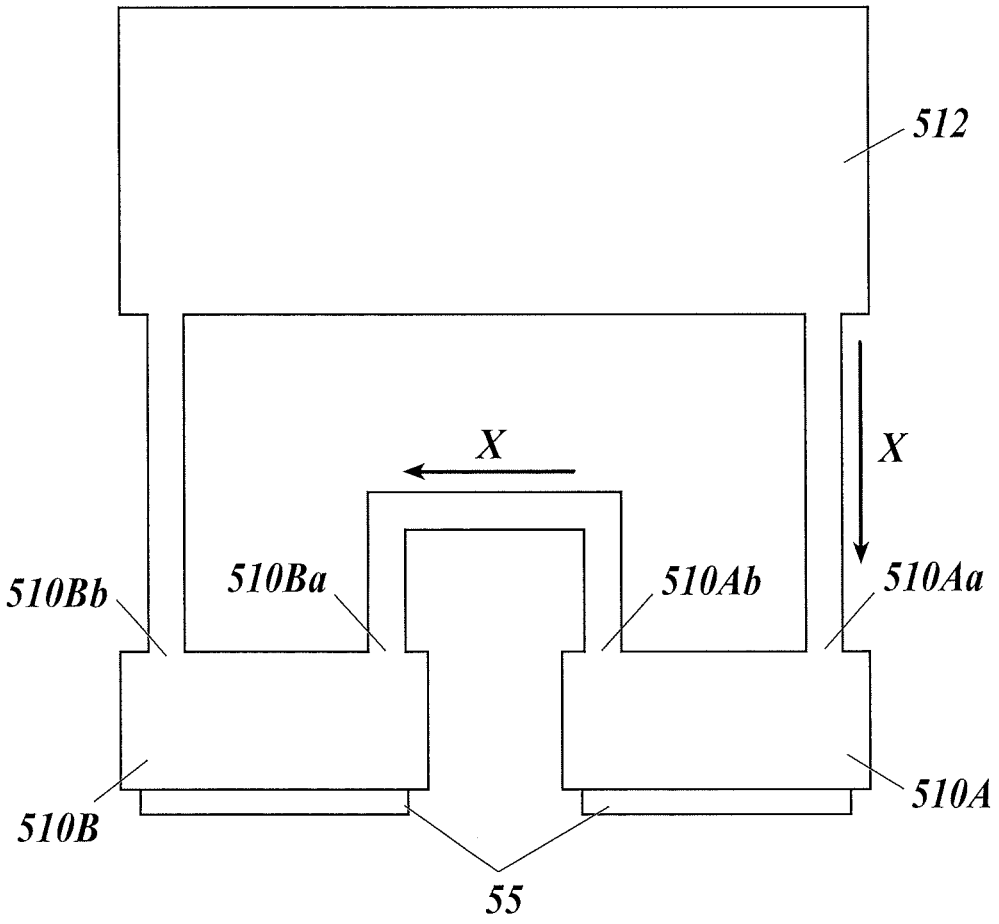
FIG. 11 This is an outline view of an ink circulation mechanism.

FIG. 11 is an outline view of the circulation flow channel. The discharge liquid flows from the discharge liquid tank 512 to the upstream recording head 510A through the inlet 510Aa in the direction X which is the flowing direction of discharge liquid. The discharge liquid flows from the outlet 510Ab through a common flow channel communicating with discharge flow channels of respective nozzles and is supplied to the inlet 510Ba of the downstream recording head 510B. The discharge liquid returns to the separate discharge liquid tank 512 through the outlet 510Bb of the downstream recording head 510B. By such configuration, the flow channel connects the outlet 510Ab of a first recording head with the inlet 510Ba of a second recording head, and by the outlet 510Bb of the second recording head being connected to the discharge liquid tank 512, the discharge liquid can be circulated. Thus, compared to the configuration in which the discharge liquid is heated from first at each recording head, the configuration of the present invention makes it possible to efficiently make the discharge liquid have a viscosity appropriate for discharge in a short time by supplying the discharge liquid heated at one recording head 510 to another recording head 510. Furthermore, by returning the discharge liquid which flows out from the downstream recording head 510B to the discharge liquid tank 512 again, the discharge liquid can be reused, and it is possible to reduce the heating of discharge liquid at the discharge liquid tank 512 and at the supply flow channel, leading to efficient heating control. The configuration is also preferable from the viewpoint of maintenance since it is possible to eject air bubbles in the recording head outside the recording head through the outlets 510Ab and 510Bb by circulating the discharge liquid when the air bubbles are mixed into the recording head.

Figure 8:
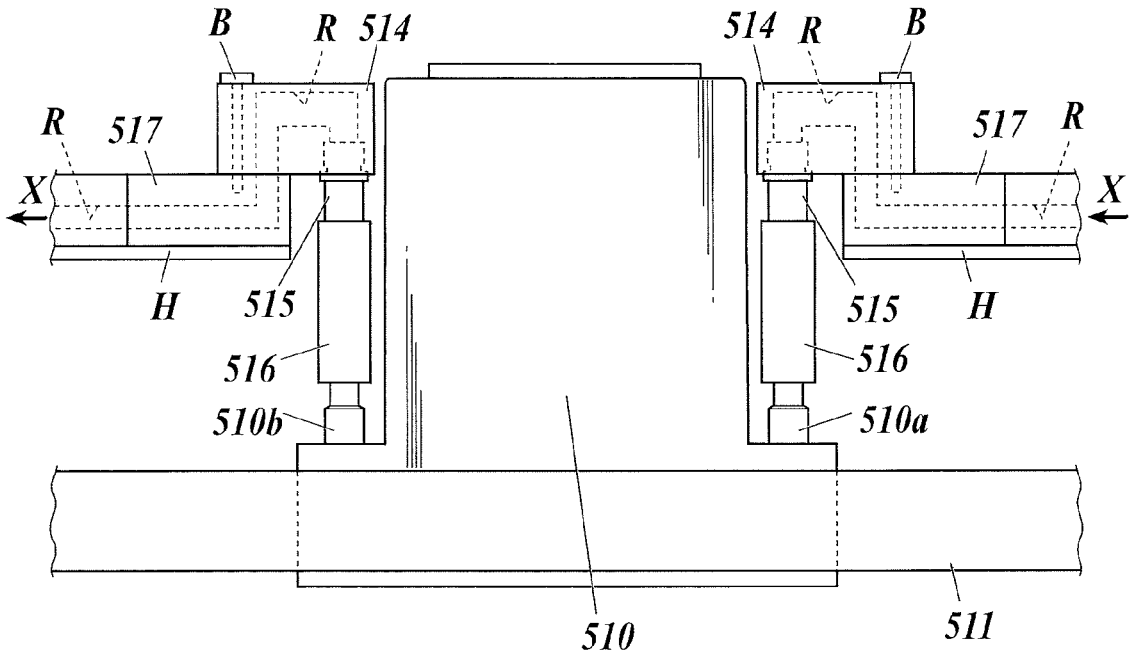
FIG. 8 This is an enlarged view showing around the recording head in the discharge section of the image formation device.

FIG. 8 is an enlarged view of such recording head 510. In such way, the recording head 510 forming a part of the above-mentioned circulation flow channel has a pair of convex inlet 510*a* and outlet 510*b* of discharge liquid, and the discharge liquid to which heating control was performed at the upstream recording head is supplied through the inlet of the downstream recording head to be used.

Next, the specific configuration of the flow channel member 513 supplying the discharge liquid to the recording head 510 will be described by using FIGS. 8 and 9. In the following description, the discharge liquid is supplied by the flow channel member 513 to the recording head, and the side of the flow channel member 513 closer to the discharge liquid tank 512 is defined as upstream and the side closer to the recording head is defined as downstream. In the flow channel member 513, first flow channel sections 514 and 515, second flow channel section 516, recording head 510 and elastic members 518 are described as a recording head unit hereinafter.

Figure 9:
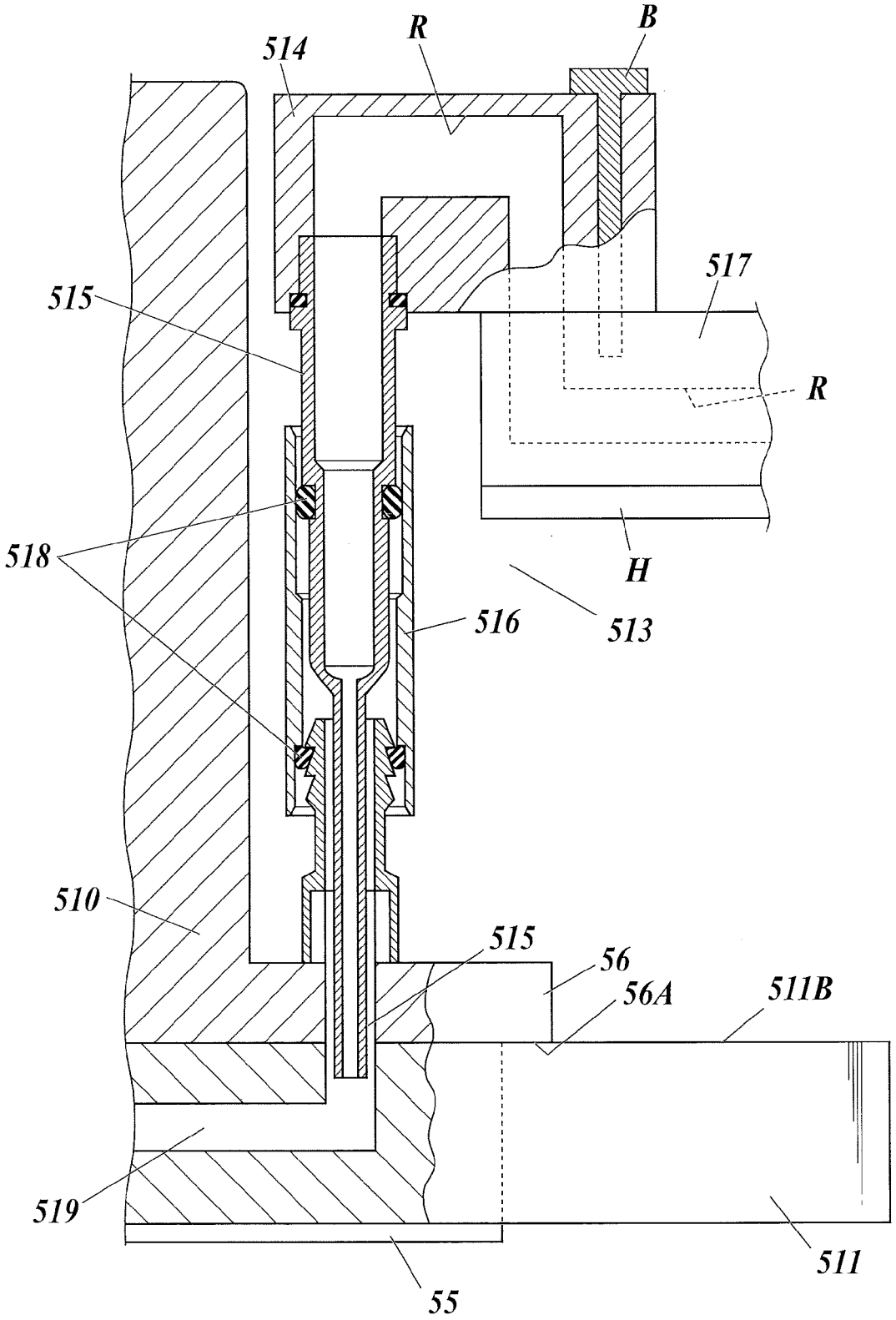
FIG. 9 This is an explanation view showing a sectional view of the recording head and a flow channel member.

FIG. 9 is an explanation view showing a cut plane of the flow channel member 513 supplying the discharge liquid to the recording head 510.

The flow channel member 513 is configured by including a member connecting the first flow channel sections 514 and 515, second flow channel section 516 and the third flow channel section 517, and forms a flow channel through which the discharge liquid supplied from the discharge liquid tank 512 is supplied to the recording head 510. A heating section H (for example, sheathed heater) for heating the third flow channel section 517 is provided on the lower surface side of the third flow channel section 517, and the discharge liquid passing a flow channel R can be heated. Here, the first flow channel sections 514 and 515 are configured by including a material having a high thermal conductivity as well as the third flow channel section 517. Accordingly, the heat added to the third flow channel section 517 by the heating section H is conducted to the first flow channel sections 514 and 515 while maintaining the high temperature, and thus, it is not necessary to heat the first flow channel sections 514 and 515 themselves by the heating section H, and there is no problem of disturbing the replacement work of recording head 510 due to a wiring of the heating section H provided near the recording head 510, allowing the maintenance of recording head 510 to be performed as usual. From the viewpoint of conducting heat of the heating section H more efficiently, it is more preferable that the first flow channel sections 514 and 515 and the third flow channel section 517 are configured by including a member having a thermal conductivity of 100 W/(m·K) or more, for example, aluminum and carbon nanotube.

The first flow channel sections 514 and 515 can be connected to the third flow channel section 517 so as to be attachable and detachable by a bolt B which can fix from the upper surface side opposite to the discharge surface 55, and thus, the flow channels of the first flow channel sections 514 and 515 and the flow channel of the third flow channel section 517 can be connected to each other.

By such configuration of connecting the flow channel sections so as to be attachable and detachable by a bolt B which can fix the flow channels from upper surface side opposite to the discharge surface 55, for example, even in a case as shown in FIG. 7 where a plurality of recording heads 510 is arranged, the recording heads 510 are close to each other and there is no space on a lateral side of each recording head 510, the bolt B can be attached and detached from the upper side relatively having more space, and thus, it is possible to replace recording heads 510 easily and accurately without generating a positioning gap due to contact with a recording head 510 which is already positioned.

Also in a case of replacing the part located downstream of the third flow channel section 517 simultaneously when replacing the recording head 510, since the heating section H is provided to the third flow channel section 517, the heating section H does not need to be replaced, and thus, it is possible to suppress the cost when replacing the part of flow channel member 513 located downstream of the third flow channel section 517 and the recording head 510.

The first flow channel sections 514 and 515 are cylindrical members, one end of the first flow channel section 515 is inserted into the inlet 510*a*, and the ink supplied from the discharge liquid tank 512 is supplied to the inlet 510*a* of recording head.

Since one end of the first flow channel section 515 is inserted into the inlet 510*a* in such way, compared to the configuration in which the inlet 510*a* of the recording head is inserted into the first flow channel section 515, it is possible to conduct the discharge liquid heated by the heat of heating section H through the first flow channel sections 514 and 515, and supply the discharge liquid into the inlet 510*a* of recording head while heating the discharge liquid by making the discharge liquid contact the first flow channel sections 514 and 515. This is preferable in an image formation device which is required to stabilize the supply of discharge liquid which transitions in phase. By the insertion configuration, it is also possible to supply the discharge liquid to a recording head flow channel 519 in the recording head while making the first flow channel sections 514 and 515 contact with the discharge liquid by extending the flow channel pipe as needed as described later.

The second flow channel section 516 is a cylindrical member covering the outside of the first flow channel section 515. The first flow channel section 515 is inserted and connected to one opening of the second flow channel section 516 via the elastic member 518, and the inlet 510*a* of recording head 510 is inserted and connected to the other opening via the elastic member 518.

In the above-mentioned second flow channel section 516, it is possible to suppress the heat release from the first flow channel section 515 and reduce the load of heating section H. Accordingly, it is preferable to use a member having a heat retaining and insulating effect, for example, a member such as stainless having a thermal conductivity less than 100 W/(m·K).

As described above, each of the first flow channel section 515 and the inlet 510*a* is connected to the second flow channel section 516 via the elastic member 518.

That is, a gap larger than a gap between members in normal fitting exists between the outer circumferential surface of first flow channel section 515 and the inner circumferential surface of the second flow channel section 516 and between the internal circumferential surface of the second flow channel section 516 and the outer circumferential surface of the inlet 510*a*, and the connection is made between the gap via the elastic member 518. Thus, it is possible to absorb the load with the elastic member 518 even when the direction or posture is slightly shifted therebetween due to the load at the connection part between the first flow channel section 515 and the second flow channel section 516.

Furthermore, the first flow channel section 515, second flow channel section 516 and inlet 510*a* have a configuration of sealing the internal space via the elastic members 518, not sealing the connection parts between the members via the elastic members 518. Thus, the configuration can avoid leakage of the discharge liquid supplied through the first flow channel section 515 to the outside of the recording head. In addition, since there is no need for sealing with a high dimensional accuracy of one end of the first flow channel section 515 and the internal diameter of the inlet 510*a*, when inserting the first flow channel section 515, it is possible to reduce the risk such as positioning gap of a positioned recording head 510 due to the contact between one end of the first flow channel section 515 and the wall surface of the inlet 510*a*.

That is, even in a case where the recording head 510 is fixed at an appropriate position, and the third flow channel section 517 and the first flow channel section 514 are connected, it is possible to connect the flow channel sections having a relatively high degree of freedom without disturbing the positioning of recording head 510. This is especially effective when adopting a full line recording system as in the embodiment which requires high accuracy of positioning.

The above-mentioned elastic member 518 is a member which is capable of elastic deformation, and it is preferable that the elastic member 518 is formed of a member resistant to discharge liquid to be discharged from the recording head 510. For example, a member in an O-ring shape formed of rubber such as nitrile rubber, styrene rubber, silicon rubber, and fluorine-containing rubber can be used as the elastic member 518.

As mentioned above, the discharge liquid can be supplied with a stable viscosity to the recording head 510 without a configuration of directly heating the first flow channel sections 514 and 515 and the second flow channel section 516.

The heat of discharge liquid supplied through the first flow channel section 515 is released to the recording head fixing plate 511 from the recording head fixing section 56 abutting on the recording head fixing plate 511 to which the recording head 510 is fixed. Accordingly, as shown in FIG. 9, it is preferable that the first flow channel section 515 is inserted to the position of recording head 510 corresponding to the recording head fixing section 56. Thereby, it is possible to supply the discharge liquid into the head with more stable viscosity even when the recording head fixing plate 511 releases heat.

Figure 14A:
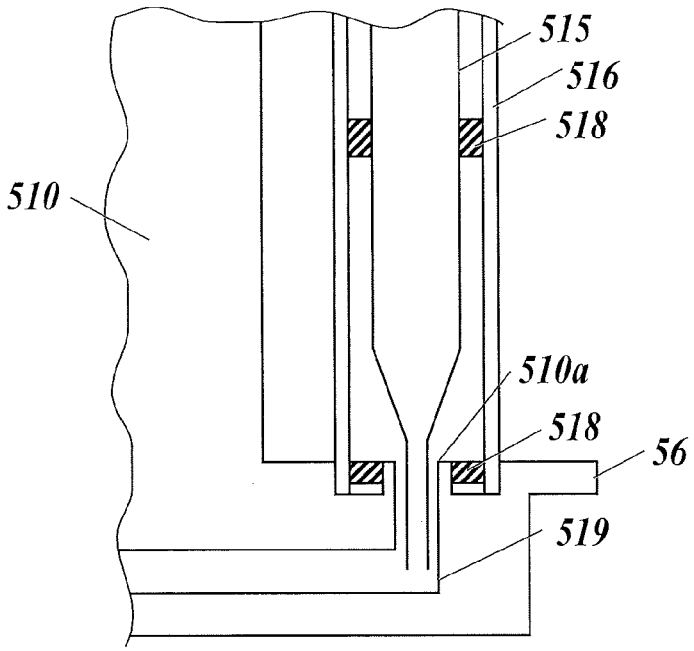
FIG. 14A This is an enlarged view of an inlet of the recording head.
Figure 14B:
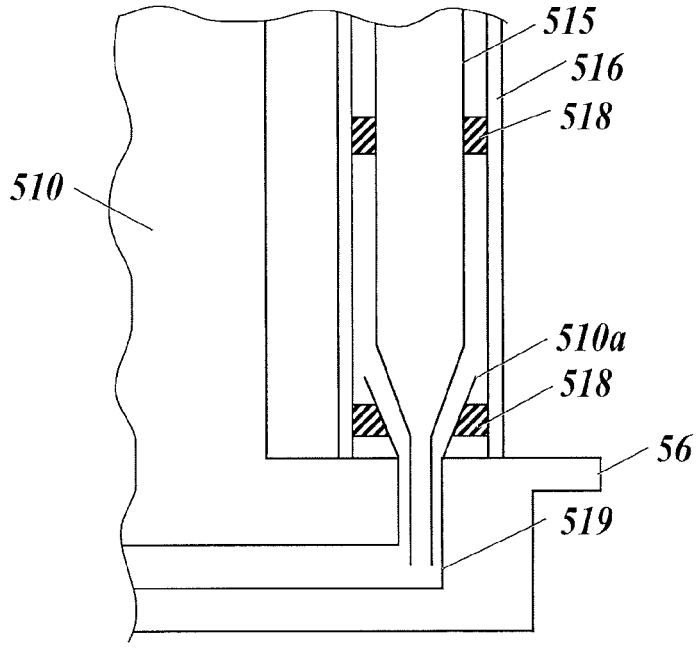
FIG. 14B This is an enlarged view of an inlet of the recording head.

The inlet 510*a* of recording head 510 in the embodiment is provided on the upper surface of the recording head fixing section 56, protrudes to the side opposite to the discharge surface 55 of recording head 510 and has a step with a sharp end. Since the inlet 510*a* protrudes and extends toward the opposite side of the discharge surface 55, that is, toward the side closer to the tank supplying the discharge liquid in such way, it is not necessary to make the first flow channel section 515 long. However, the shape of the inlet 510*a* is not limited to this, and any arbitrary shape may be used as long as there is a slight gap between the outer circumferential surface of the inlet 510*a* and the internal circumferential surface of the second flow channel section 516 and they can be connected via the elastic member 518. Each of FIGS. 14A and 14B is an enlarged view of the inlet 510*a* showing a shape other than the inlet 510*a* of recording head 510 in the embodiment. As shown in FIG. 14A, the present invention may have a configuration in which the inlet 510*a* itself does not protrude, a concave portion is provided around the inlet 510*a*, one end of the second flow channel section 516 is inserted into the concave portion via the elastic member 518, and as a result, the inlet 510*a* is connected to the second flow channel section 516 via the elastic member 518. Also, as shown in FIG. 14B, the present invention can similarly adopt the configuration in which the inlet 510*a* reversely has a flared end.

In the embodiment, the first flow channel section is formed of two members of 514 and 515; however, these members may be a single member one end of which is connected to the third flow channel section 517 and the other end of which is connected to the inlet 510*a*, and the discharge liquid may be supplied from the discharge liquid tank 512 to the recording head 510 through the first flow channel section, and thus, the present invention is not limited to the embodiment.

In the embodiment, the respective elastic members 518 between the inlet 510*a* and the second flow channel section 516 and between the first flow channel section 515 and the second flow channel section 516 are formed of separate O-rings; however, the elastic members 518 may be formed as a united elastic member 518.

The heating in the present invention is not only direct heating by the heating section H but also heating by the member which receives heat conducting from the heating section H, and the heating section H can be disposed at any position as long as the flow channel member 513 can be heated. Alternatively, all the used recording heads 510 may be connected to form a single circulation path, or all the used recording heads may be divided into a plurality of groups to form a plurality of circulation paths by the groups.

(Main Control Configuration of Image Formation Device)

Figure 10:
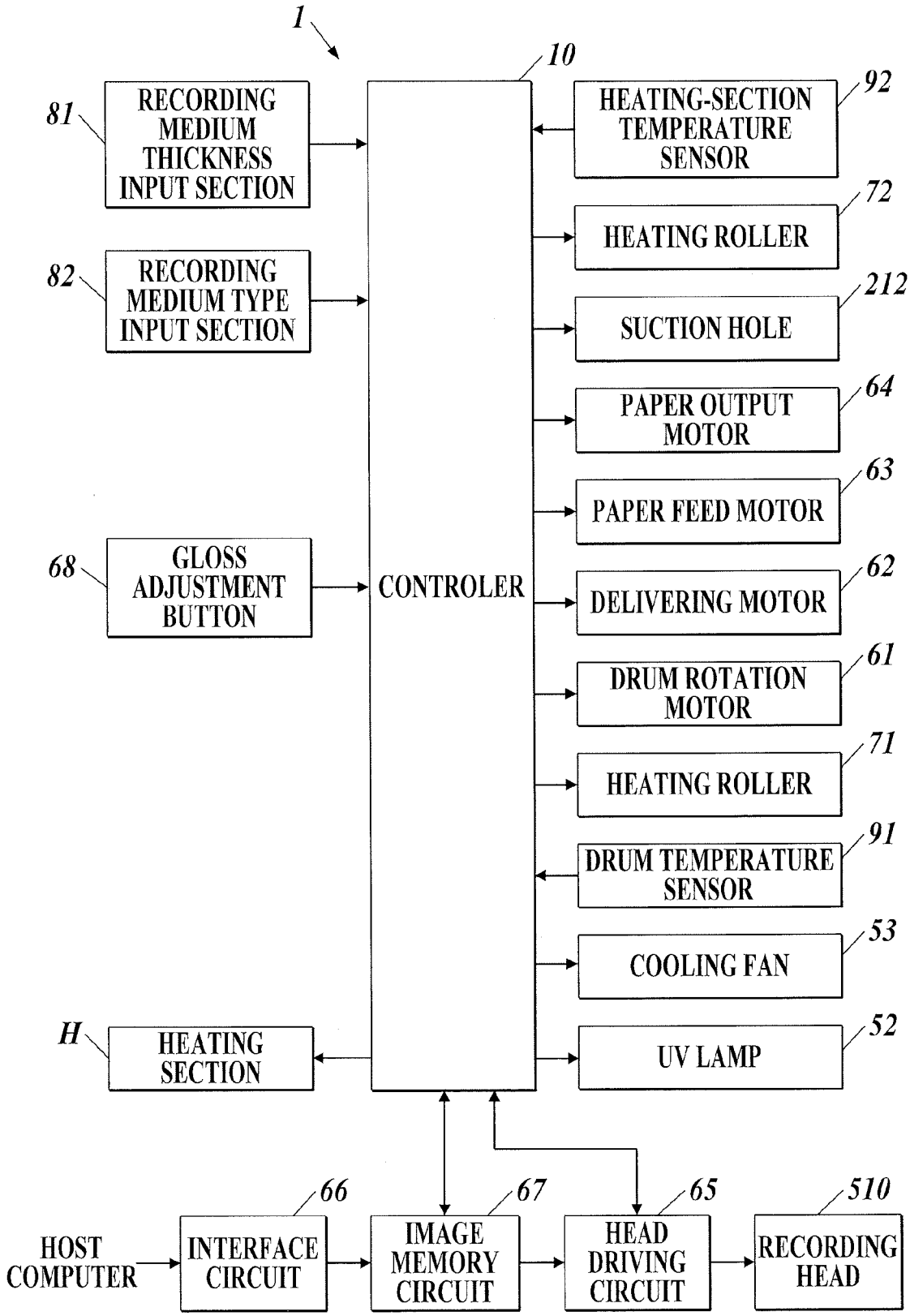
FIG. 10 This is a block diagram showing a control system of the image formation device.

FIG. 10 is a block diagram showing the main control configuration of image formation device 1. As shown in FIG. 10, the controller 10 of image formation device 1 is electrically connected to a delivering motor 62 which rotates the delivering drum 22, a drum rotation motor 61 which rotates the image formation drum 21, a paper feed motor 63 which drives driving sections of paper feed section 3, a paper output motor 64 which drives driving sources of the accumulation section 4, a head driving circuit 65 which drives the discharge section 51 (head section 51*a*), a drum temperature sensor 91, a heating roller 71, a heating-section temperature sensor 92, a heating roller 72, suction holes 212, a UV lamp 52, a cooling fan 53, a heating section H, a gloss adjustment button 68 for an operator to set and input the degree of gloss of formed image, a recording medium thickness input section 81 and a recording medium type input section 82.

The controller 10 is constituted of a ROM which stores a program to control each component of the image formation device 1, a CPU which executes the program, and a RAM which is a work area at the time of the execution of the program, for example.

Further, an image memory circuit 67 which stores the data of image to be formed inputted from a host computer via an interface circuit 66 is provided in addition to the controller 10. The CPU of the controller 10 performs computing on the basis of image data stored in the image memory circuit 67 and the program, and sends a control signal to each component on the basis of the computing results.

The controller 10 performs heat control of the heating roller 71.

The recording medium thickness input section 81 is a section with which an operator inputs the thickness of a recording medium P on which image formation is to be performed. The recording medium type input section 82 is a section with which an operator inputs the type of recording medium P on which image formation is to be performed.

The controller 10 performs heat control according to the thickness and the type of recording medium P. Specifically, the controller 10 stores table data where the set temperatures T4 and T5 of the heating roller 71 are set according to the two parameters of the type and thickness of recording medium P. The controller 10 performs the processing of determining the set temperatures T4 and T5 on the basis of the input of these.

The heating roller 71 is provided in order to raise the temperature of a recording medium P to a desired temperature range quickly. T4 and T5 are determined according to the thermal conductivity of the heating roller 71 and a contact time between the heating roller 71 and a recording medium P, for example.

The table below shows an example of the table data where the set temperatures T4 and T5 are set according to the two parameters of the type and thickness of recording medium P. The temperatures in the table are all expressed in Celsius. T1 in the table is the lower limit of the range of image-forming-drum set temperature, which is the target temperature band of the image formation drum 21 at the time of image formation; T2 is the intermediate value of the range of image-forming-drum set temperature; and T3 is the upper limit of the range of set temperature of the image formation drum 21.

TABLE 1

UNIT ° C.

| | | | | THICKNESS OF RECORDING MEDIUM | | | | | |
|---|---|---|---|---|---|---|---|---|---|
| | | | | 0.1-0.2 mm | | 0.2-0.4 mm | | 0.3-0.6 mm | |
| TYPE OF RECORDING MEDIUM | T1 | T2 | T3 | T4 | T5 | T4 | T5 | T4 | T5 |
| GOOD QUALITY PAPER | 40 | 45 | 46 | 108 | 114 | 131 | 138 | 154 | 162 |
| COATED PAPER | 42 | 47 | 48 | 111 | 117 | 137 | 144 | 162 | 171 |
| CAST-COATED PAPER | 43 | 48 | 49 | 114 | 120 | 143 | 150 | 171 | 180 |
| CLEAR PET | 43 | 48 | 49 | 105 | 111 | 125 | 132 | 145 | 153 |

(Discharge Liquid)

The discharge liquid used in the embodiment is an activating beam curable ink which is cured by being irradiated with energy rays (activating beams, for example, ultraviolet rays). The activating beam curable ink contains a gelling agent in an amount of 1 percent by mass or more but less than 10 percent by mass, and exhibits a reversible sol-gel phase transition depending on temperature. The term "so-gel phase transition" used herein refers to a phenomenon in which a liquid state having fluidity at an elevated temperature is transformed into a non-fluid gel state at a cooled temperature lower than or equal to a gelation temperature, and the non-fluid state at a cooled temperature is reversibly transformed into a liquid state having fluidity when heated to a temperature higher than or equal to the solation temperature.

The term "gelation" refers to a solidified, semi-solidified, or thickened state accompanied by sharp increases in viscosity and elasticity; for example, a lamella structure, a polymer network formed by non-covalent bonds or hydrogen bonds, a polymer network formed by physical aggregation, and an aggregated structure composed of substances each immobilized by interactions between fine particles or between deposited fine crystals. The term "solation" refers to a liquid state having a fluidity in which the interactions formed during the gelation are released. The term "solation temperature" used in the present invention refers to a temperature at which a gel ink is warmed to be transformed into a sol state and have fluidity. The term "gelation temperature" refers to a temperature at which a sol ink is cooled to be transformed into a gel state and have reduced fluidity.

The activating beam curable ink, which exhibits such so-gel phase transition, is transformed into a liquid state at an elevated temperature, and thus can be ejected from a recording head 510. Upon recording using the activating beam curable ink at an elevated temperature, ink drops on a recording medium are spontaneously cooled and rapidly solidified by a temperature difference. This can prevent poor quality of an image due to integration of adjacent dots. Unfortunately, ink drops that are readily solidified may be isolated from each other to form a rough image. The roughness may lead to inhomogeneous gloss such as extremely low gloss and unnatural glitter. Vigorous investigation by the inventor found that the control of solidifying properties of ink drops, a gelation temperature of ink, and the temperature of a recording medium within the following range can prevent poor image quality due to integration of the ink drops, and can also achieve highly natural gloss on the image. Specifically, printing with the ink which contains a gelling agent in an amount ranging of 0.1 percent by mass or more but less than 10 percent by mass and has a viscosity of $10^2$ mPa·s or higher but lower than $10^5$ mPa·s at 25° C., under the control of the difference between the gelation temperature ($T_{gel}$) of ink with the gelling agent and the surface temperature ($T_s$) of the recording medium within the range of 5 to 15° C. can prevent integration of the ink drops and thus simultaneously achieve high image quality and natural gloss on an image. In this case, the temperature of the medium is controlled within the range of 42 to 48° C.

The inventor guesses that such a phenomenon involves the following processes. When an ink drop ejected onto a recording medium is solidified before an adjacent ink drop is ejected, low gloss and unnatural glitter on an image are caused; whereas, when adjacent ink drops are solidified a certain time after the ink drops are ejected and integrated with each other, extremely poor image quality is caused due to overlap of the ink drops. Vigorous investigation by the inventor found that the control of viscosity of the ejected ink drops can prevent integration of ink drops and facilitate proper leveling of adjacent ink drops, which leads to natural gloss on an image.

Printing with the ink containing a gelling agent in an amount of 0.1 percent by mass or more but less than 10 percent by mass and exhibiting a viscosity of $10^2$ mPa·s or higher but lower than $10^5$ mPa·s at 25° C. allows the viscosity of the ink to be controlled within the temperature range of substrate. This control can simultaneously achieve high image quality and natural gloss on an image. Such a finding is based on the following assumption: an ink having viscosity lower than $10^2$ mPa·s at 25° C. cannot sufficiently prevent the integration of ink drops, and thus causes poor image quality within the above-described temperature range. An ink having viscosity of $10^5$ mPa·s or higher at 25° C. may exhibit high viscosity after gelation and cause a noticeable increase in viscosity during a cooling process. The viscosity of such an ink is barely controlled to an extent to be properly leveled within the above-described temperature range, which may reduce the gloss of an image. Contrarily, the ink of the present invention, which is transformed into a viscous gel having proper viscosity after gelation, can effectively inhibit the solidification of the dots, and thus achieve image quality exhibiting relatively natural gloss.

The term "homogeneous gloss" does not define an absolute gloss, e.g., a specular reflection gloss at 60 degree. It, however, refers to entirely homogeneous gloss of an image (in particular, a solid printing image) without partially inhomogeneous gloss of the image, e.g., unnatural glitter, undesirable decreases in gloss, and stripe inconsistencies in gloss on the image, due to microscopic differences in gloss.

Use of the activating beam curable ink under the control of the difference between the gelation temperature ($T_{gel}$) of the ink and the surface temperature ($T_s$) of the recording medium within the range of 5 to 15° C. can prevent poor image quality, and achieve high image quality exhibiting high sharpness of fine lines in characters and natural gloss. To achieve higher image quality, the temperature of the recording medium is preferably controlled within the range of 5 to 10° C.

The composition of the activating beam curable ink used in the present invention will now be described in sequence.

(Gelling Agent)

Typical examples of gels include a thermoreversible gel and a non-thermoreversible gel. The thermoreversible gel is transformed into a fluid solution (also referred to as "sol") when heated, while it is reversibly transformed into gel when cooled. The non-thermoreversible gel is not reversibly transformed into a fluid solution when heated once it gelates. The gel, which contains an oil gelling agent, is preferably a thermoreversible gel to prevent clogging of the recording heads.

The gelation temperature (phase transition temperature) of the activating beam curable ink used in the present invention is preferably 40° C. or higher but lower than 100° C., and more preferably, ranges from 45 to 70° C. Taking into account summer environmental conditions, an ink exhibiting a phase transition at a temperature of 40° C. or higher can be stably ejected from a recording head 510 regardless of the environment temperature during printing. An ink exhibiting a phase transition at a temperature lower than 90° C. eliminates the need for heating of an image formation device to an extremely high temperature, which can reduce load on the recording heads 510 of and the components of the ink supply system of an image formation device.

The term "gelation temperature", which refers to a temperature at which a liquid having fluidity is transformed into a gel form accompanied by a rapid change in viscosity, is a synonym of a "gel transition temperature", "gel dissolution temperature", "phase transition temperature", "sol-gel phase transition temperature", and "gelation point".

In the present invention, a gelation temperature of ink is calculated from a viscosity curve and a viscoelasticity curve observed with, for example, a rheometer (e.g., a stress controlled rheometer having a cone-plate, PhysicaMCR, Anton Paar Ltd.). The viscosity curve is observed during a temperature change in a sol ink at an elevated temperature under a low shear rate, whereas the viscoelasticity curve is observed during a measurement of a temperature change dependent on dynamic viscoelasticity. One example technique to obtain a gelation temperature involves placing a small piece of iron sealed in a glass tube into a dilatometer. With the temperature varied, a temperature at which the piece of iron in the ink liquid stops free-falling is determined to be a phase transition point (J. Polym. Sci., 21, 57 (1956)). Another example technique involves placing an aluminum cylinder on an ink to be subjected to a temperature change for gelation. A temperature at which the aluminum cylinder begins free-falling is determined to be a gelation temperature (Nihon Reoroji Gakkaishi (Journal of the Society of Rheology, Japan), Vol. 17, 86(1989)). An example simple technique involves placing a specimen in a gel form on a heat plate to be heated. A temperature at which the shape of the specimen collapses is determined to be a gelation temperature. Such a gelation temperature (phase transition temperature) of an ink can be controlled depending on the type of the gelling agent, the amount of the added gelling agent, and the type of the activating beam curable monomer.

The ink to be discharged preferably has a viscosity of $10^2$ mPa·s or higher but lower than $10^5$ mPa·s at 25° C., and more preferably, of $10^3$ mPa·s or higher but lower than $10^4$ mPa·s. Ink having a viscosity of $10^2$ mPa·s or higher can prevent poor image quality due to the integration of dots, while ink having a viscosity of lower than $10^5$ mPa·s can be properly leveled after being ejected onto a recording medium under a controlled surface temperature of the recording medium, and thus can provide homogeneous gloss. The viscosity of the ink can be effectively controlled depending on the type of the gelling agent, the amount of the added gelling agent, and the type of the activating beam curable monomer. The viscosity of the ink is observed with a stress controlled rheometer including a cone-plate (PhysicaMCR, Anton Paar, Ltd.), at a shear rate of 11.7 $s^{-1}$.

The gelling agent contained in the ink as the discharge liquid according to the present invention may be composed of a high-molecular compound or low-molecular compound; however, the gelling agent is preferably composed of a low-molecular compound because it can readily ejected from recording heads.

Non-limiting specific examples of the gelling agents which can be formulated in the ink as discharge liquid according to the present invention are listed below.

Specific examples of high-molecular compounds preferably used include fatty acids with inulin, such as inulin stearate; dextrins of fatty acids, such as dextrin palmitate and dextrin myristate (Rheopearl, available from Chiba Flour Milling Co., Ltd.); glyceryl behenate/eicosadioate; and polyglyceryl behenate/eicosadioate (Nom Coat, available from The Nisshin Oillio Group, Ltd.).

Examples of low-molecular compounds preferably used include oil gelling agents having low molecular weight; amid compounds, such as N-lauroyl-L-glutamic acid dibutylamide and N-2-ethylhexanoyl-L-glutamic acid dibutylamide (available from Ajinomoto Fine-Techno Co., Inc.); dibenzylidene sorbitol compounds, such as 1,3:2,4-bis-O-benzylidene-D-glucitol (Gell All D available from New Japan Chemical Co., Ltd.); petroleum-derived waxes, such as paraffin wax, micro crystalline wax, and petrolatum; plant-derived waxes, such as candelilla wax, carnauba wax, rice wax, Japan wax, jojoba oil, jojoba solid wax, and jojoba ester; animal-derived waxes, such as beewax, lanolin, and spermaceti; mineral waxes, such as montan wax and hydrogenated wax; denatured waxes such as hardened castor oil and hardened castor oil derivatives, montan wax derivatives, paraffin wax derivatives, micro crystalline wax derivatives, and polyethylene wax derivatives; higher fatty acids, such as behenic acid, arachidic acid, stearic acid, palmitic acid, myristic acid, lauric acid, oleic acid, and erucic acid; higher alcohols such as a stearyl alcohol and behenyl alcohol; hydroxystearic acids, such as 12-hydroxystearic acid; derivatives of 12-hydroxystearic acid; fatty acid amides, such as a lauric acid amide, stearic acid amide, behenic acid amide, oleic acid amide, erucic acid amide, ricinoleic acid amide, and 12-hydroxystearic acid amide (for example, Nikka Amide from Nippon Kasei Chemical Co., Ltd, ITO-WAX available from Itoh Oil Chemicals Co., Ltd, and FATTYAMID available from Kao Corporation); N-substituted fatty acid amides, such as N-stearyl stearic acid amide, N-oleyl palmitic acid amide; special fatty acid amides, such as N,N'-ethylenebisstearylamide N,N'-ethylenebis(12-hydroxystearic amide), and N,N'-xylylene bisstearylamide; higher amines, such as dodecylamine, tetradecylamine, and octadecylamine; fatty acid esters, such as stearyl stearate, oleyl palmitate, glycerin fatty acid ester, sorbitan fatty acid ester, propylene glycol fatty acid ester, ethylene glycol fatty acid ester, and polyoxyethylene glycol fatty acid ester (e.g., EMALLEX available from Nihon Emulsion Co., Ltd., Rikemal available from Riken Vitamin Co., Ltd., and Poem available from Riken Vitamin Co., Ltd.); sucrose fatty acid esters, such as sucrose stearate and sucrose palmitate (for example, Ryoto Sugar Ester available from Mitsubishi-Kagaku Foods Corporation); synthetic waxes, such as polyethylene wax and α-olefin maleic anhydride copolymer wax; polymerizable waxes (UNILIN from Baker-Petrolite Corporation); dimer acids and dimer diols (PRIPOR available from Croda International Plc); which are described in Japanese Patent Application Laid Open Publication Nos. 2005-126507, 2005-255821, and 2010-111790. These gelling agents may be used alone or in combination as appropriate.

The ink as discharge liquid of the present invention, which contains the gelling agent, is transformed into a gel form immediately after being ejected from a recording head 510 onto a recording medium. This prevents the mixing and integration of dots and thus can provide high quality image during high-speed printing. The ink dots are then cured by activating beams to be fixed on the recording medium, forming a firm image film. The amount of the gelling agent included in the ink is preferably 1 percent by mass or more but less than 10 percent by mass, and more preferably, 2 percent by mass or more but less than 7 percent by mass. The ink containing the gelling agent in an amount of 1 percent by mass or more can be subjected to sufficient gelation and thus can prevent poor image quality due to the integration of the dots. Moreover, the ink drops having increased viscosity after gelation are photoradically cured with a decrease in photocurable properties due to oxygen inhabitation. The ink containing the gelling agent of less than 10 percent by mass can prevent poor quality of a cured film due to non-cured component after irradiation with activating beams and can prevent poor inkjet characteristics.

(Activating Beam-curable Compositions)

The ink as discharge liquid of the present invention is characterized in that it contains a gelling agent, coloring material, and an activating beam curable composition cured by activating beams.

The activating beam curable composition (hereinafter also referred to as "photopolymerizable compound") will now be described.

Examples of the activating beams include electron beams, ultraviolet rays, α beams, γ beams, and x-rays; however, ultraviolet rays and electron beams are preferred that are less damaging the human body, easy to handle, and industrially widespread. In the present invention, ultraviolet rays are particularly preferred.

In the present invention, any photopolymerizable compound that can be cross-linked or polymerized by irradiation with activating beams may be used without limitation; and, photo-cationically or photo-radically polymerizable compounds are preferred.

(Cationically Polymerizable Compound)

Any known cationically polymerizable monomers may be used; examples of the cationically polymerized monomers include epoxy compounds, vinyl ether compounds, and oxetane compounds described in Japanese Patent Application Laid Open Publication Nos. 6-9714, 2001-31892, 2001-40068, 2001-55507, 2001-310938, 2001-310937, and 2001-220526.

In the present invention, the photopolymerizable compound preferably contains at least one oxetane compound and at least one compound selected from an epoxy compound and a vinyl ether compound in order to prevent contraction of the recording medium during curing of the ink.

Preferred examples of aromatic epoxides include di- or poly-glycidyl ethers prepared by the reaction of polyhydric phenol having at least one aromatic nucleus or an alkylene oxide adduct thereof with epichlorohydrin, such as diglycidyl or polyglycidyl ethers of bisphenol A or an alkylene oxide adduct thereof, diglycidyl or polyglycidyl ethers of hydrogenated bisphenol A or an alkylene oxide adduct thereof, and novolac epoxy resin. Examples of the alkylene oxides include ethylene oxide and propylene oxide.

Preferred examples of alicyclic epoxides include a cyclohexene oxide-containing compound and a cyclopentane oxide-containing compound that are prepared by epoxidizing a compound having at least one cycloalkane ring such as a cyclohexene ring and a cyclopentene ring with a proper oxidant, such as hydrogen peroxide and a peracid.

Preferred examples of aliphatic epoxides include diglycidyl or polyglycidyl ethers of aliphatic polyhydric alcohols or alkylene oxide adducts thereof. Representative examples of the diglycidyl or polyglycidyl ethers include diglycidyl ethers of alkylene glycols, such as diglycidyl ether of ethylene glycol, diglycidyl ether of propylene glycol, and diglycidyl ether of 1,6-hexanediol; polyglycidyl ethers of polyhydric alcohols, such as diglycidyl ether or triglycidyl ether of glycerine or alkylene oxide adducts thereof; and diglycidyl ethers of polyalkylene glycols, such as diglycidyl ethers of polyethylene glycol or alkylene oxide adducts thereof, and diglycidyl ethers of polypropylene glycol or alkylene oxide adducts thereof. Examples of the alkylene oxides include ethylene oxide and propylene oxide.

Preferred epoxides among these epoxides are aromatic epoxides and alicyclic epoxides, and more preferred are alicyclic epoxides because of their rapid curability. In the present invention, the above-described epoxides may be used alone or in combination as appropriate.

Examples of vinyl ether compounds include di- or tri-vinyl ether compounds, such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexane dimethanol divinyl ether, and trimethylolpropane trivinyl ether; and monovinyl ether compounds, such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexane dimethanol monovinyl ether, n-propyl vinyl ether, isopropyl vinyl ether, isopropenyl ether o-propylenecarbonate, dodecyl vinyl ether; diethylene glycol monovinyl ether, and octadecyl vinyl ether.

Preferred vinyl ether compounds among these vinyl ether compounds are di- or tri-vinyl ether compounds, and more preferred are di-vinyl ether compounds because of their curing properties, adhesion, and surface hardness. In the present invention, the above-described vinyl ether compounds may be used alone or in combination as appropriate.

The term "oxetane compound" refers to a compound having one or more oxetane rings. Any known oxetane compound may be used, for example, described in Japanese Patent Application Laid Open Publication Nos. 2001-220526 and 2001-310937.

The use of an oxetane compound having five or more oxetane rings in the present invention may lead to an increase in viscosity of the ink composition. Such an ink composition is hard to handle, has a high glass transition temperature, and thus exhibits low adhesion after curing. The oxetane compound used in the present invention thus is preferably a compound having one to four oxetane rings.

Example of the oxetane compounds preferably used in the present invention include compounds represented by Formulae (1), (2), (7), (8), and (9) respectively described in paragraphs [0089], [0092], [0107], [0109], and [0166] of Japanese Patent Application Laid Open Publication No. 2005-255821.

Specific examples of the oxetane compounds include example compounds 1 to 6 described in paragraphs [0104] to [0119], and compounds described in paragraph [0121] of Japanese Patent Application Laid Open Publication No. 2005-255821.

(Radically Polymerizable Compound)

A radically polymerizable compound will now be described.

Any known radically polymerizable monomers may be used as photo-radically polymerizable monomers. Example of the known radically polymerizable monomers include photo-curable material prepared using photo-polymerizable compounds, and cationically polymerizable photo-curable resin, which are described in Japanese Patent Application Laid Open Publication No. 7-159983, Japanese Examined Patent Application Publication No. 7-31399, and Japanese Patent Application Laid Open Publication Nos. 8-224982 and 10-863. In addition to these monomers, photo-cationically polymerizable photo-curable resin that is sensitized to light having wavelengths longer than those of visible light, may also be used as a photo-radically polymerizable monomer, the resin being described in Japanese Patent Application Laid Open Publication Nos. 6-43633 and No. 8-324137, for example.

Radically polymerizable compounds have radically polymerizable ethylenically unsaturated bonds. Any radically polymerizable compound that has at least one radically polymerizable ethylenically unsaturated bond in a molecule may be used that has a chemical form such as a monomer, oligomer, or polymer. Such radically polymerizable compounds may be used alone or in combination in any proportion to improve target properties.

Examples of the compounds having the radically polymerizable ethylenically unsaturated bond(s) include unsaturated carboxylic acids, such as acrylic acid, methacrylic acid, itaconic acid, crotonic acid, isocrotonic acid, and maleic acid, and salts thereof; esters, urethanes, amides, anhydrides of these unsaturated carboxylic acids; acrylonitrile; styrene; and radically polymerizable compounds such as various unsaturated polyesters, unsaturated polyethers, unsaturated polyamides, and unsaturated urethanes.

In the present invention, any known (meth)acrylate monomers and/or oligomers may be used as radically polymerizable compounds. The term "and/or" used herein means that the radically polymerizable compound may be a monomer, oligomer, or combination thereof. The same is applied to the term "and/or" in the following description.

Example compounds having (meth)acrylate groups include monofunctional monomers, such as isoamyl acrylate, stearyl acrylate, lauryl acrylate, octyl acrylate, decyl acrylate, isomyristyl acrylate, isostearyl acrylate, 2-ethylhexyl diglycol acrylate, 2-hydroxybutyl acrylate, 2-acryloyloxyethyl hexahydrophthalate, butoxyethyl acrylate, ethoxydiethylene glycolacrylate, methoxydiethylene glycolacrylate, methoxypolyethylene glycolacrylate, methoxypropylene glycolacrylate, phenoxyethyl acrylate, tetrahydrofurfuryl acrylate, isobornyl acrylate, 2-hydroxyethyl acrylate, 2-hydroxypropyl acrylate, 2-hydroxy 3-phenoxypropyl acrylate, 2-acryloyloxy ethylsuccinic acid, 2-acryloyloxyethylphthalic acid, 2-acryloyloxyethyl 2-hydroxyethylphthalate, lactone modified flexible acrylate, and t-butylcyclohexyl acrylate; bifunctional monomers, such as triethylene glycol diacrylate, tetraethylene glycol diacrylate, polyethylene glycol diacrylate, tripropylene glycol diacrylate, polypropylene glycol diacrylate, 1,4-butanediol diacrylate, 1,6-hexanediol diacrylate, 1,9-nonanediol diacrylate, neopentyl glycol diacrylate, dimethylol tricyclodecane diacrylate, bisphenol-A PO-adduct diacrylate, hydroxypivalate neopentyl glycol diacrylate, and polytetramethylene glycol diacrylate; and multifunctional (tri- or higher functional) monomers, such as trimethylolpropane triacrylate, pentaerythritol triacrylate, pentaerythritol tetraacrylate, dipentaerythritol hexaacrylate, ditrimethylolpropane tetraacrylate, glycerine propoxy triacrylate, caprolactone-modified trimethylolpropane triacrylate, pentaerythritol ethoxy tetraacrylate, and caprolactam-modified dipentaerythritol hexaacrylate. In addition to these monomers, polymerizable oligomers may be used. Examples of the polymerizable oligomers include epoxy acrylates, aliphatic urethane acrylates, aromatic urethane acrylates, polyester acrylates, linear acylic oligomers. More specifically, commercially available or industrially known monomers, oligomers, and polymers that can be radically polymerized and crosslinked may be used, which are described in "Kakyozai Handobukku (Cross-linker Handbook)", Shinzo Yamashita (Taiseisha, 1981); "UV•EB Kouka Handobukku (Genryo Hen) (UV•EB Curing Handbook (Material))", Kiyomi Kato, (Koubunshi Kankoukai, 185); "UV•EB Koukagijyutsu no Ouyo to Shijyo (Application and Market of UV•EB Curing Technology) ", pp. 79, RadTech Japan (CMC Publishing Co., Ltd., 1989); "Poriesuteru Jyushi Handbook (Polyester Resin Handbook) ", Eiichiro Takiyama, (Nikkan Kogyo Shimbun Ltd., 1988).

Specific examples of the preferred monomers include isoamyl acrylate, stearyl acrylate, lauryl acrylate, octyl acrylate, decyl acrylate, isomyristyl acrylate, isostearyl acrylate, ethoxydiethylene glycol acrylate, methoxypolyethylene glycol acrylate, methoxypropylene glycol acrylate, isobornyl acrylate, lactone-modified flexible acrylate, tetraethylene glycol diacrylate, polyethylene glycol diacrylate, polypropylene glycol diacrylate, dipentaerythritol hexaacrylate, di(trimethylolpropane) tetraacrylate, glycerine propoxy triacrylate, caprolactone-modified trimethylolpropane triacrylate, pentaerythritol ethoxy tetraacrylate, and caprolactam-modified dipentaerythritol hexaacrylate in the light of their sensitivity, skin irritancy, eye irritancy, mutagenicity, and toxicity.

Specifically, more preferred monomers among these monomers are stearyl acrylate, lauryl acrylate, isostearyl acrylate, ethoxydiethylene glycol acrylate, isobornyl acrylate, tetraethylene glycol diacrylate, glyceryl propoxy triacrylate, caprolactone-modified trimethylolpropane triacrylate, and caprolactam-modified dipentaerythritol hexaacrylate.

The polymer of the present invention may be combinations of vinyl ether monomer and/or oligomer and (meth) acrylate monomer and/or oligomer. Examples of the vinyl ether monomers include di- or tri-vinyl ether compounds, such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexane dimethanol divinyl ether, and trimethylolpropane trivinyl ether; and monovinyl ether compounds, such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexane dimethanol monovinyl ether, n-propyl vinyl ether, isopropyl vinyl ether, isopropenyl ether o-propylene carbonate, dodecyl vinyl ether, diethylene glycol monovinyl ether, and octadecyl vinyl ether. The vinyl ether oligomer is preferably a bifunctional vinyl ether compound having a molar weight of 300-1000 and two to three ester groups in a molecule. Non-limiting examples of such bifunctional vinyl ether compounds include VEctomer available from Sigma-Aldrich Co. LLC., such as VEctomer 4010, VEctomer 4020, VEctomer 4040, VEctomer 4060, and VEctomer 5015.

The polymer of the present invention may be combinations of various vinyl ether compounds and maleimide compounds. Non-limiting examples of the maleimide compounds include N-methylmaleimide, N-propylmaleimide, N-hexylmaleimide, N-laurylmaleimide, N-cyclohexylmaleimide, N-phenylmaleimide, N,N'-methylenebismaleimide, polypropylene glycol bis(3-maleimidepropyl) ether, tetraethylene glycol bis(3-maleimidepropyl) ether, bis(2-maleimide ethyl) carbonate, N,N'-(4,4'-diphenylmethane)bismaleimide, N,N'-2,4-tolylene bismaleimide, and multifunctional maleimide compounds which are ester compounds containing carboxylic acids and various polyols, the multifunctional maleimides compound being described in Japanese Patent Application Laid Open Publication No. 11-124403.

The amount of added cationic polymer or radically polymerizable compound described above is preferably within a range of 1 to 97 percent by mass, and more preferably, of 30 to 95 percent by mass.

(Components of Ink)

Components, other than the components described above, of the ink of the present invention will now be described.

(Color Material)

The ink may contain any dye or pigment as a color material. The preferred materials are pigments with stable dispersion in the ink components and weatherability. Examples of pigments according to the invention include, but not limited to, organic and inorganic pigments represented by the following color index numbers, which can be used in accordance with the purpose.

Red or magenta pigments: Pigment Reds 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, and 257; Pigment Violets 3, 19, 23, 29, 30, 37, 50, and 88; and Pigment Oranges 13, 16, 20, and 36. Blue or cyan pigments: Pigment Blues 1, 15, 15:1, 15:2, 15:3, 15:4, 15:6, 16, 17-1, 22, 27, 28, 29, 36, and 60. Green pigments: Pigment Greens 7, 26, 36, and 50. Yellow pigments: Pigment Yellows 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, and 193. Black pigments: Pigment Blacks 7, 28, and 26.

Specific examples of the pigments include CHROMOFINE YELLOWs 2080, 5900, 5930, AF-1300, and AF-2700L; CHROMOFINE ORANGEs 3700L and 6730; CHROMOFINE SCARLET 6750; CHROMOFINE MAGENTAs 6880, 6886, 6891N, 6790, and 6887; CHROMOFINE VIOLET RE; CHROMOFINE REDs 6820 and 6830; CHROMOFINE BLUEs HS-3, 5187, 5108, 5197, 5085N, SR-5020, 5026, 5050, 4920, 4927, 4937, 4824, 4933GN-EP, 4940, 4973, 5205, 5208, 5214, 5221, and 5000P; CHROMOFINE GREENs 2GN, 2GO, 2G-550D, 5310, 5370, and 6830; CHROMOFINE BLACK A-1103; SEIKAFAST YELLOWs 10GH, A-3, 2035, 2054, 2200, 2270, 2300, 2400(B), 2500, 2600, ZAY-260, 2700(B), and 2770; SEIKAFAST REDs 8040, C405(F), CA120, LR-116, 1531B, 8060R, 1547, ZAW-262, 1537B, GY, 4R-4016, 3820, 3891, and ZA-215; SEIKAFAST CARMINEs 6B1476T-7, 1483LT, 3840, and 3870; SEIKAFAST BORDEAUX 10B-430; SEIKALIGHT ROSE R40; SEIKALIGHT VIOLETs B800 and 7805; SEIKAFAST MAROON 460N; SEIKAFAST ORANGEs 900 and 2900; SEIKALIGHT BLUEs C718 and A612; CYANINE BLUEs 4933M, 4933GN-EP, 4940, and 4973 (Dainichiseika Color & Chemicals Mfg. Co., Ltd.); KET Yellows 401, 402, 403, 404, 405, 406, 416, and 424; KET Orange 501; KET Reds 301, 302, 303, 304, 305, 306, 307, 308, 309, 310, 336, 337, 338, and 346; KET Blues 101, 102, 103, 104, 105, 106, 111, 118, and 124; KET Green 201 (DIC Corporation), Colortex Yellows 301, 314, 315, 316, P-624, 314, U10GN, U3GN, UNN, UA-414, and U263; Finecol Yellows T-13 and T-05; Pigment Yellow 1705; Colortex Orange 202, Colortex Reds 101, 103, 115, 116, D3B, P-625, 102, H-1024, 105C, UFN, UCN, UBN, U3BN, URN, UGN, UG276, U456, U457, 105C, and USN; Colortex Maroon 601; Colortex Brown B610N; Colortex Violet 600; Pigment Red 122; Colortex Blues 516, 517, 518, 519, A818, P-908, and 510; Colortex Greens 402 and 403; Colortex Blacks 702 and U905 (Sanyo Color Works. LTD.); Lionol Yellow 1405G; Lionol Blues FG7330, FG7350, FG7400G, FG7405G, ES, and ESP-S (Toyo Ink SC Holdings Co., Ltd.); Toner Magenta E02; Permanent Rubin F6B; Toner Yellow HG; Permanent Yellow GG-02; Hostaperm Blue B2G (Hoechst Industry Ltd.); Novoperm P-HG; Hostaperm Pink E; Hostaperm Blue B2G (Clariant International Ltd.); and Carbon Blacks #2600, #2400, #2350, #2200, #1000, #990, #980, #970, #960, #950, #850, MCF88, #750, #650, MA600, MA7, MA8, MA11, MA100, MA100R, MA77, #52, #50, #47, #45, #45L, #40, #33, #32, #30, #25, #20, #10, #5, #44, and CF9 (Mitsubishi Chemical Corporation).

The pigments may be dispersed, for example, with a ball mill, a sand mill, an attritor, a roll mill, an agitator, a Henschel mixer, a colloid mill, an ultrasonic homogenizer, a pearl mill, a wet jet mill, or a paint shaker.

A dispersant may be added for dispersion of the pigments. The preferred dispersant is a polymer dispersant. Examples of polymer dispersants include Solsperse® series by Avecia Inc., PB series by Ajinomoto Fine-Techno Co., Inc., and the following materials.

Pigment dispersants: hydroxyl-containing carboxylic acid esters, salts of long-chain polyaminoamides and high-molecular-weight acid esters, salts of high-molecular-weight polycarboxylic acids, salts of long-chain polyaminoamides and polar acid esters, high-molecular-weight unsaturated acid esters, copolymers, modified polyurethanes, modified polyacrylates, polyether-ester anionic surfactants, salts of naphthalenesulfonic acid-formalin condensates, salts of aromatic sulfonic acid-formalin condensates, polyoxyethylene alkyl phosphate esters, polyoxyethylene nonylphenyl ethers, stearylamine acetates, and pigment derivatives.

Specific examples of polymer dispersants include: ANTI-TERRA-U (polyaminoamide phosphate salt), ANTI-TERRA-203 and ANTI-TERRA-204 (high-molecular-weight polycarboxylates), DISPERBYK-101 (polyaminoamide phosphate and acid ester), DISPERBYK-107 (hydroxyl group-containing carboxylic acid ester), DISPERBYK-110 (copolymer containing acid group), DISPERBYK-130 (polyamide), DISPERBYK-161, -162, -163, -164, -165, -166, and -170 (high molecular weight copolymers), 400, Bykumen (high-molecular-weight unsaturated acid ester), BYK-P104 and BYK-P105 (high-molecular-weight unsaturated polycarboxylic acids), BYK-P104S and -P240S (high molecular weight unsaturated polycarboxylic acids and silicon), and Lactimon (long-chain amine, unsaturated polycarboxylic acid, and silicon) by BYK-Chemie GmbH.

Further examples include: Efkas 44, 46, 47, 48, 49, 54, 63, 64, 65, 66, 71, 701, 764, and 766, Efka Polymers 100 (modified polyacrylate), 150 (aliphatic modified polymer), 400, 401, 402, 403, 450, 451, 452, 453 (modified polyacrylates), and 745 (copper phthalocyanine) by Efka Chemicals B.V.; FLOWREN TG-710 (urethane oligomer), FLOWNONs SH-290 and SP-1000, POLYFLOW Nos. 50E and 300 (acrylic copolymers) by Kyoeisha Chemical Co., Ltd.; Disparlons KS-860, 873SN, and 874 (polymer dispersants), and Disparlon #2150 (aliphatic polyvalent carboxylic acid) and #7004 (polyether ester) by Kusumoto Chemicals, Ltd.

Still further examples include: DEMOLs RN, N (sodium naphthalene sulfonate-formaldehyde condensates), MS, C, SN-B (sodium aromatic sulfonate-formaldehyde condensates), and EP, HOMOGENOL L-18 (polycarboxylic polymer), EMULGENs 920, 930, 931, 935, 950, and 985 (polyoxyethylene nonylphenyl ethers), ACETAMINs 24 (coconut amine acetate), and 86 (stearyl amine acetate) by Kao Corporation; SOLSPERSEs 5000 (phthalocyanine ammonium salt), 13240, 13940 (polyester amines), 17000 (aliphatic amine), 24000, and 32000 by AstraZeneca plc; and NIKKOL T106 (polyoxyethylene sorbitan monooleate), MYS-IEX (polyoxyethylene monostealate), and Hexagline 4-0 (hexaglyceryl tetraoleate) by Nikko Chemicals Co., Ltd.

The ink preferably contains a pigment dispersant in an amount of 0.1 to 20 percent by mass. Synergists dedicated to the respective pigments may be used as dispersion aids. The dispersant and dispersion aids are preferably added in amounts of 1 to 50 parts by mass for 100 parts by mass of pigments. A dispersion medium may be a solvent or a polymerizable compound. Preferably, the ink of the present invention, which is subjected to reaction and curing after printing, contains no solvent. Residual solvent in cured-ink images causes a problem of the decrease in solvent resistance and a volatile organic compound (VOC) of the residual solvent. The preferred dispersion media are therefore polymerizable compounds, especially a monomer with the lowest viscosity rather than a solvent, in view of dispersion characteristics.

The pigment preferably has an average particle diameter in the range of 0.08 to 0.5 μm and a maximum diameter of 0.3 to 10 μm, more preferably 0.3 to 3 μm in view of dispersion of the pigment. These diameters are appropriately determined depending on the types of the pigment itself, dispersant, and dispersion medium, dispersion conditions, and filtration conditions. Such size control prevents nozzle clogging in the recording head 510 and leads to high storage stability, transparency, and curing sensitivity of the ink.

The ink of the present invention may optionally contain a known dye, preferably an oil-soluble dye. Non-limiting oil-soluble dyes that can be used in the present invention are listed below.

(Magenta Dye)

MS Magenta VP, MS Magenta HM-1450, and MS Magenta HSo-147 (Mitsui Chemicals, Inc.); AIZENSOT Red-1, AIZEN SOT Red-2, AIZEN SOT Red-3, AIZEN SOT Pink-1, and SPIRON Red GEH SPECIAL (Hodogaya Chemical Co., Ltd.); RESOLIN Red FB 200%, MACROLEX Red Violet R, and MACROLEX ROT5B (Bayer); KAYASET Red B, KAYASET Red 130, and KAYASET Red 802 (Nippon Kayaku Co., Ltd.); PHLOXIN, ROSE BENGAL, and ACID Red (Daiwa Kasei Co., Ltd.); HSR-31 and DIARESIN Red K (Mitsubishi Chemical Corporation); and Oil Red (BASF Japan Ltd.).

(Cyan Dye)

MS Cyan HM-1238, MS Cyan HSo-16, Cyan HSo-144, and MS Cyan VPG (Mitsui Chemicals, Inc.); AIZEN SOT Blue-4 (Hodogaya Chemical Co., Ltd.); RESOLIN BR.Blue BGLN 200%, MACROLEX Blue RR, CERES Blue GN, SIRIUS SUPRA TURQ.Blue Z-BGL, and SIRIUS SUPRA TURQ.Blue FB-LL 330% (Bayer); KAYASET Blue FR, KAYASET Blue N, KAYASET Blue 814, Turq.Blue GL-5 200, and Light Blue BGL-5 200 (Nippon Kayaku Co., Ltd.); DAIWA Blue 7000 and Oleosol Fast Blue GL (Daiwa Kasei Co., Ltd.); DIARESIN Blue P (Mitsubishi Chemical Corporation); and SUDAN Blue 670, NEOPEN Blue 808, and ZAPON Blue 806 (BASF Japan Ltd.).

(Yellow Dye)

MS Yellow HSm-41, Yellow KX-7, and Yellow EX-27 (Mitsui Chemicals, Inc.); AIZEN SOT Yellow-1, AIZEN SOT YelloW-3, and AIZEN SOT Yellow-6 (Hodogaya Chemical Co., Ltd.); MACROLEX Yellow 6G and MACROLEX FLUOR.Yellow 10GN (Bayer); KAYASET Yellow SF-G, KAYASET Yellow 2G, KAYASET Yellow A-G, and KAYASET Yellow E-G (Nippon Kayaku Co., Ltd.); DAIWA Yellow 330HB (Daiwa Kasei Co., Ltd.); HSY-68 (Mitsubishi Chemical Corporation); and SUDAN Yellow 146 and NEOPEN Yellow 075 (BASF Japan Ltd.).

(Black Dye)

MS Black VPC (Mitsui Chemicals, Inc.); AIZEN SOT Black-1 and AIZEN SOT Black-5 (Hodogaya Chemical Co., Ltd.); RESORIN Black GSN 200% and RESOLIN BlackBS (Bayer); KAYASET Black A-N(Nippon Kayaku Co., Ltd.); DAIWA Black MSC (Daiwa Kasei Co., Ltd.); HSB-202 (Mitsubishi Chemical Corporation); and NEPTUNE Black X60 and NEOPEN Black X58 (BASF Japan Ltd.).

The pigments or oil-soluble dyes are preferably added in amounts of 0.1 to 20 percent by mass, more preferably 0.4 to 10 percent by mass. Addition of 0.1 percent by mass or more yields desirable image quality, and addition of 20 percent by mass or less provides appropriate ink viscosity during ejection of ink. Two or more colorants may be appropriately used for color adjustment.

(Photopolymerization Initiator)

The ink of the present invention preferably contains at least one photopolymerization initiator when ultraviolet rays, for example, are used as activating beams. For use of electron beams as activating beams, no photopolymerization initiator is necessary in many cases.

Photopolymerization initiators are broadly categorized into two types: an intramolecular bonding cleavage type and an intramolecular hydrogen abstraction type.

Photopolymerization initiators of the intramolecular bonding cleavage type include acetophenones, such as diethoxyacetophenone, 2-hydroxy-2-methyl-1-phenylpropan-1-one, benzyl dimethyl ketal, 1-(4-isopropylphenyl)-2-hydroxy-2-methylpropan-1-one, 4-(2-hydroxyethoxy)phenyl 2-hydroxy-2-propyl ketone, 1-hydroxycyclohexyl phenyl ketone, 2-methyl-2-morpholino(4-thiomethylphenyl)propan-1-one, and 2-benzyl-2-dimethylamino-1-(4-morpholinophenyl)-butanone; benzoins, such as benzoin, benzoin methyl ethers, and benzoin isopropyl ethers; acylphosphine oxides, such as 2,4,6-trimethyl benzoin diphenylphosphine oxide; benzyl; and methyl phenylglyoxylate.

Photopolymerization initiators of the intramolecular hydrogen abstraction type include benzophenones, such as benzophenone, o-benzoylbenzoic acid, methyl-4-phenyl benzophenone, 4,4'-dichlorobenzophenone, hydroxybenzophenone, 4-benzoyl-4'-methyl diphenyl sulfide, acrylated benzophenone, 3,3',4,4'-tetra(t-butylperoxycarbonyl)benzophenone, and 3,3'-dimethyl-4-methoxy benzophenone; thioxanthones, such as 2-isopropylthioxanthone, 2,4-dimethylthioxanthone, 2,4-diethylthioxanthone, and 2,4-dichlorothioxanthone; aminobenzophenones, such as Michler's ketone and 4,4'-diethylamino benzophenone; 10-butyl-2-chloroacridone; 2-ethylanthraquinone; 9,10-phenanthrenequinone; and camphorquinone.

The preferred amount of a photopolymerization initiator, if used, is 0.01 to 10 percent by mass of an activating beam curable composition.

Examples of the radical polymerization initiators include triazine derivatives disclosed in documents, such as Japanese Examined Patent Application Publication Nos. S59-1281 and S61-9621, and Japanese Patent Application Laid Open Publication No. S60-60104; organic peroxides disclosed in documents, such as Japanese Patent Application Laid Open Publication Nos. S59-1504 and S61-243807; diazonium compounds disclosed in documents, such as Japanese Examined Patent Application Publication Nos. S43-23684, S44-6413, S44-6413, and S47-1604 and U.S. Pat. No. 3,567,453; organic azide compounds disclosed in documents, such as U.S. Pat. Nos. 2,848,328, 2,852,379, and 2,940,853; orthoquinonediazides disclosed in documents, such as Japanese Examined Patent Application Publication Nos. S36-22062, S37-13109, S38-18015, and S45-9610; onium compounds disclosed in documents, such as Japanese Examined Patent Application Publication No. S55-39162 and Japanese Patent Application Laid Open Publication No. S59-14023 and *Macromolecules*, 10, P. 1307, 1977; azo compounds disclosed in Japanese Patent Application Laid Open Publication No. S59-142205; metal allene complexes disclosed in documents, such as Japanese Patent Application Laid Open Publication No. H1-54440, EP patent Nos. 109,851 and 126,712 and *J. Imag. Sci.,* 30, P. 174, 1986; (oxo)sulfoniumorganoboron complexes disclosed in Japanese Patent Nos. 2711491 and 2803454; titanocene dichlorides disclosed in Japanese Patent Application Laid Open Publication No. S61-151197; transition metal complexes containing transition metals, such as ruthenium disclosed in *Coordination Chemistry Review,* 84, pp. 85-277, 1988 and Japanese Patent Application Laid Open Publication No. H2-182701; 2,4,5-triarylimidazole dimer; carbon tetrabromide disclosed in Japanese Patent Application Laid Open Publication No. H3-209477; and organic halogen compounds disclosed in Japanese Patent Application Laid Open Publication No. S59-107344. The preferred amount of a polymerization initiator ranges from 0.01 to 10 parts by mass for 100 parts by mass of a compound containing a radically polymerizable ethylenically unsaturated bond.

The ink may contain a photoacid generator serving as a photopolymerization initiator.

As photoacid generators, compounds that are used, for example, for a chemically amplified photoresist or photo cationic polymerization are used (The Japanese Research Association for Organic Electronics Materials (ed.), *Organic materials for imaging*, pp. 187-192, BUNSHIN, 1993). Examples of such a compound suitable for the present invention are as follows.

First group: salts of aromatic onium compounds, such as diazonium, ammonium, iodonium, sulfonium, and phosphonium with $B(C_6F_5)_4^-$, $PF_6^-$, $AsF_6^-$, $SbF_6^-$, or $CF_3SO_3^-$.

Specific examples of the onium compound usable in the invention are disclosed in paragraph [0132] of Japanese Patent Application Laid Open Publication No. 2005-255821.

Second group: sulfonated compounds generating sulfonic acid. Specific examples of such a sulfonated compound are disclosed in paragraph [0136] of Japanese Patent Application Laid Open Publication No. 2005-255821.

Third group: halides photogenerating hydrogen halide. Specific examples of such a halide are disclosed in paragraph [0138] of Japanese Patent Application Laid Open Publication No. 2005-255821.

Fourth group: iron-allene complexes disclosed in paragraph of Japanese Patent Application Laid Open Publication No. 2005-255821.

(Other Addictive Agents)

The activating beam curable ink according to the present invention may also contain a variety of additives, other than those described above. Examples of such additives include surfactants, leveling agents, matting agents, polyester resins for adjusting membrane properties, polyurethane resins, vinyl resins, acrylic resins, elastomeric resins, and waxes. Any known basic compound can be used for improvement in storage stability. Typical examples include basic alkali metal compounds, basic alkali earth metal compounds, and basic organic compounds, such as amines.

Inks used in this embodiment are listed below.

Pigment dispersion elements for the following ink composition are obtained by heating and stirring a mixture of 5 parts by mass of SOLSPERSE 32000 (Lubrizol Corporation) and 80 parts by mass of HD-N (1,6-hexanediol dimethacrylate: Shin-Nakamura Chemical Co., Ltd.) in a stainless steel beaker to dissolve the mixture, cooling the mixture to room temperature, adding 15 parts by mass of Carbon Black #56 (Mitsubishi Chemical Corporation) to the mixture, putting the mixture and zirconia beads of 0.5 mm in a sealed glass vial, performing dispersion of the mixture with a paint shaker for 10 hours, and removing the zirconia beads therefrom.

TABLE 2

| | NAME | MANUFACTURER | AMOUNT (PART) |
|---|---|---|---|
| POLYMERIZABLE COMPOUND | A-600 | SHIN-NAKAMURA CHEMICAL CO., LTD. | 50 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 4.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |

TABLE 2-continued

| | NAME | MANUFACTURER | AMOUNT (PART) |
|---|---|---|---|
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 3

| | NAME | MANUFACTURER | AMOUNT (PART) |
|---|---|---|---|
| POLYMERIZABLE COMPOUND | 9G | SHIN-NAKAMURA CHEMICAL CO., LTD. | 35 |
| POLYMERIZABLE COMPOUND | U-200PA | SHIN-NAKAMURA CHEMICAL CO., LTD. | 5 |
| POLYMERIZABLE COMPOUND | 3G | SHIN-NAKAMURA CHEMICAL CO., LTD. | 19.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | DAROCUR TPO | BASF | 3 |
| PHOTOPOLYMERIZATION INITIATOR | PROCURE TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 4

| | NAME | MANUFACTURER | AMOUNT (PART) |
|---|---|---|---|
| POLYMERIZABLE COMPOUND | 14G | SHIN-NAKAMURA CHEMICAL CO., LTD. | 45 |
| POLYMERIZABLE COMPOUND | A-HD-N | SHIN-NAKAMURA CHEMICAL CO., LTD. | 14.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 5

| | NAME | MANUFACTURER | AMOUNT (PART) |
|---|---|---|---|
| POLYMERIZABLE COMPOUND | UA-4200 | SHIN-NAKAMURA CHEMICAL CO., LTD. | 35 |
| POLYMERIZABLE COMPOUND | A-HD-N | SHIN-NAKAMURA CHEMICAL CO., LTD. | 24.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 6

| | NAME | MANUFACTURER | AMOUNT (PART) |
|---|---|---|---|
| POLYMERIZABLE COMPOUND | AD-TMP | SHIN-NAKAMURA CHEMICAL CO., LTD. | 30 |
| POLYMERIZABLE COMPOUND | A-GLY-9E | SHIN-NAKAMURA CHEMICAL CO., LTD. | 20 |
| POLYMERIZABLE COMPOUND | HD-N | SHIN-NAKAMURA CHEMICAL CO., LTD. | 9.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 7

| | NAME | MANUFACTURER | AMOUNT (PART) |
|---|---|---|---|
| POLYMERIZABLE COMPOUND | U-200PA | SHIN-NAKAMURA CHEMICAL CO., LTD. | 13 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 41.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |

TABLE 7-continued

| | NAME | MANUFACTURER | AMOUNT (PART) |
|---|---|---|---|
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

As described above in detail, according to the present invention, by the above-mentioned recording head unit supplying a discharge liquid from the discharge liquid tank 512 to a recording head 510, it is possible to supply the discharge liquid to the recording head 510 in a state where the discharge liquid is warmed so as not to raise the viscosity thereof, and to stabilize the supply of discharge liquid to the recording head 510. That is, the discharge liquid can be supplied with a stable discharge viscosity to the connection part between the recording head main body and the supply flow channel connected thereto. Furthermore, since the recording head 510 can be disposed to the image formation device main body while maintaining the positioning accuracy, it is possible to provide an image formation device which is excellent in high image quality and speeding up.

In the embodiment, a full line recording head is used as the image formation device, and the embodiment is described by using an ink jet recording device configured by including an ink circulation flow channel which ejects a specific ink as the discharge liquid; however, the present invention is not necessarily limited to this.

That is, even in an image formation device using a general scan type recording head and an image formation device not using an ink circulation mechanism, the present invention can be similarly applied if the discharge liquid needs to be supplied with the above-mentioned stable viscosity and the positioning accuracy of recording head 510 is required.

The discharge liquid is also not limited to the above-mentioned activating beam curable ink. An ink and a discharge liquid other than ink which require stable management of viscosity by heating can also be used as well as other phase transition ink, for example, ink such as hot-melt ink and wax ink.

The present invention is not limited to the above-mentioned embodiment, and changes can be appropriately made within the scope of the present invention.

INDUSTRIAL APPLICABILITY

The image formation device according to the present invention is applicable in the image formation field of ejecting discharge liquid from recording heads onto a recording medium to perform image formation.

EXPLANATION OF REFERENCE NUMERALS

1 image formation device
2 image formation section
3 paper feed section
4 accumulation section
21 image formation drum
51 discharge section
51*a* head section
51*b* carriage
510 recording head
510*a* inlet
510*b* outlet
511 recording head fixing plate
512 discharge liquid tank
513 flow channel member
514 first flow channel section
515 first flow channel section
516 second flow channel section
517 third flow channel section
518 elastic member
519 recording head flow channel
52 UV lamp
53 cooling fan
54 recording head fixing frame
55 discharge surface
56 recording head fixing section
H heating section
P recording medium
R flow channel
X flow direction of discharge liquid

The invention claimed is:

1. An image formation device, comprising:

a recording head which has a plurality of nozzles for discharging a discharge liquid onto a conveyed recording medium, the discharge liquid being supplied to an inside of the recording head through an inlet;

a flow channel member which is connected to the inlet and forms a flow channel for supplying the discharge liquid to the recording head; and a heating section which heats the flow channel member, wherein the flow channel member includes:

a first flow channel section one end of which is inserted into the inlet; and a second flow channel section that is a cylindrical member inside of which the first flow channel section passes through and that externally covers a connection part between the one end of the first flow channel section and the inlet, and the second flow channel section is connected with each of the first flow channel section and the inlet via an elastic member, and the one end of the first flow channel section and the inlet are connected to each other.

2. The image formation device according to claim 1, wherein the first flow channel section is a member having a thermal conductivity of 100 W/(m·K) or more.

3. The image formation device according to claim 1, wherein the second flow channel section is a member having a thermal conductivity less than 100 W/(m·K).

4. The image formation device according to claim 1, wherein the flow channel member includes a third flow channel section which is connected to the other end of the first flow channel section, and the first flow channel section and the third flow channel section are connected to each other so as to be attachable and detachable.

5. The image formation device according to claim 4, wherein the heating section heats the third flow channel section.

6. The image formation device according to claim 1, further comprising:

a plurality of recording heads; and a holding member which holds the plurality of recording heads, wherein the plurality of recording heads is arranged along a direction orthogonal to a conveyance direction of the recording medium so that the nozzles are across an entire width of the direction orthogonal to the conveyance direction of the recording medium.

7. The image formation device according to claim 6, wherein the holding member has an opening in which a part of the recording head including a discharge surface to discharge the discharge liquid is insertable, and the recording head includes a recording head fixing section which includes an abutting surface to abut on the holding member, the abutting surface being formed on a side closer to the discharge surface than the inlet and being parallel to the discharge surface, the recording head is held by exposing the discharge surface through the opening and making the abutting surface abut on the holding member, and the one end of the first flow channel section is inserted through the inlet to the abutting surface.

8. The image formation device according to claim 7, wherein the inlet is formed in a shape protruding from the recording head fixing section toward an opposite side of the discharge surface.

9. The image formation device according to claim 1, wherein the discharge liquid changes in phase between a gel form or a solid form and a liquid form according to a temperature.

10. The image formation device according to claim 9, wherein a gelation temperature of the discharge liquid is equal to or more than 40° C. and less than 90° C.

11. An image formation device, comprising:

a first recording head including a first inlet through which a discharge liquid is supplied, a first outlet from which the discharge liquid flows out, and a plurality of nozzles which discharges the discharge liquid onto a conveyed recording medium, the discharge liquid being supplied to an inside of the first recording head through the first inlet;

a second recording head including a second inlet which is connected to the first outlet of the first recording head, a second outlet from which the discharge liquid flows out, and a plurality of nozzles which discharges the discharge liquid onto the conveyed recording medium, the discharge liquid flowing out from the first outlet and being supplied to an inside of the second recording head through the second inlet;

a first flow channel member which is connected to the first inlet and forms a flow channel to supply the discharge liquid to the first recording head;

a second flow channel member which is connected to the second inlet and forms a flow channel to supply the discharge liquid to the second recording head, the discharge liquid flowing out from the first outlet of the first recording head; and a heating section which heats the first and second flow channel members, wherein each of the first and second flow channel members includes:

a first flow channel section one end of which is inserted into the first or second inlet; and a second flow channel section that is a cylindrical member inside of which the first flow channel section passes through and that externally covers a connection part between the one end of the first flow channel section and the first or second inlet, and the second flow channel section is connected with each of the first flow channel section and the first or second inlet via an elastic member, and the one end of the first flow channel section and the first or second inlet are connected to each other.

12. The image formation device according to claim 11, wherein the first flow channel section of each of the first flow channel member and the second flow channel member is a member having a thermal conductivity of 100 W/(m·K) or more.

13. The image formation device according to claim 11, wherein the second flow channel section of each of the first flow channel member and the second flow channel member is a member having a thermal conductivity less than 100 W/(m·K).

14. The image formation device according to claim 11, wherein the first flow channel member and the second flow channel member includes a third flow channel section which is connected to the other end of the first flow channel section, and the first flow channel section and the third flow channel section are connected to each other so as to be attachable and detachable.

15. The image formation device according to claim 14, wherein the heating section heats the third flow channel section.

16. The image formation device according to claim 11, further comprising a holding member which holds the first recording head and the second recording head, wherein the first recording head and the second recording head are arranged along a direction orthogonal to a conveyance direction of the recording medium so that the nozzles are across an entire width of the direction orthogonal to the conveyance direction of the recording medium.

17. The image formation device according to claim 16, wherein the holding member has an opening in which a part of the first recording head or the second recording head including a discharge surface to discharge the discharge liquid is insertable, and each of the first recording head and the second recording head includes a recording head fixing section which includes an abutting surface to abut on the holding member, the abutting surface being formed on a side closer to the discharge surface than the first inlet or the second inlet and being parallel to the discharge surface, each of the first recording head and the second recording head is held by exposing the discharge surface through the opening and making the abutting surface abut on the holding member, and the one end of the first flow channel section is inserted through the first inlet or the second inlet to the abutting surface.

18. The image formation device according to claim 17, wherein each of the first inlet and the second inlet is formed in a shape protruding from the recording head fixing section toward an opposite side of the discharge surface.

19. The image formation device according to claim 11, wherein the discharge liquid changes in phase between a gel form or a solid form and a liquid form according to a temperature.

20. The image formation device according to claim 19, wherein a gelation temperature of the discharge liquid is equal to or more than 40° C. and less than 90° C.

* * * * *